US010480118B2

(12) United States Patent
Bringewatt et al.

(10) Patent No.: US 10,480,118 B2
(45) Date of Patent: Nov. 19, 2019

(54) METHOD AND APPARATUS FOR FEEDING ITEMS OF LAUNDRY TO A LAUNDRY TREATMENT DEVICE, PREFERABLY A MANGLE

(71) Applicant: Herbert Kannegiesser GmbH, Vlotho (DE)

(72) Inventors: Wilhelm Bringewatt, Porta Westfalica (DE); Thomas Klarhorst, Vlotho (DE); Arthur Malikowski, Detmold (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 84 days.

(21) Appl. No.: 15/715,461

(22) Filed: Sep. 26, 2017

(65) Prior Publication Data

US 2018/0087213 A1 Mar. 29, 2018

(30) Foreign Application Priority Data

Sep. 29, 2016 (DE) ..... 10 2016 011 676

(51) Int. Cl.
*D06F 67/04* (2006.01)

(52) U.S. Cl.
CPC ..... *D06F 67/04* (2013.01)

(58) Field of Classification Search
CPC ..... D06F 67/04; D06F 95/00; D06F 69/00; D06C 3/00
See application file for complete search history.

(56) References Cited

U.S. PATENT DOCUMENTS 3,483,645 A * 12/1969 Gilmore ..... D06F 67/04 38/143
3,664,046 A * 5/1972 Thompson ..... D06F 67/04 198/570

(Continued)

FOREIGN PATENT DOCUMENTS

DE 102005024801 A1 11/2006
DE 102008021810 A1 4/2009

(Continued)

OTHER PUBLICATIONS

European Patent Office, Europaischer Recherchenbericht (search in a related application), May 17, 2018.

(Continued)

*Primary Examiner* — Ismael Izaguirre
(74) *Attorney, Agent, or Firm* — Laurence P. Colton; Smith Tempel Blaha LLC

(57) ABSTRACT

Items of laundry are fed to mangles by insertion machines, which have a spreading device with moveable spreading clips which spread out and center a front transverse edge of the item of laundry upstream of a feed conveyor. A plurality of loading stations are located upstream of the spreading device. The spreading clips retrieve an item of laundry from the loading stations, which, in the case of outer loading stations, requires long movement distances of the spreading clips, which reduces the cycle time of the insertion machine. The invention makes provision to transfer items of laundry from outer loading stations to transfer clips which move the items of laundry from the outer loading stations into the vicinity of the center of the feed conveyor, then transfer the item of laundry to the spreading clips in the center of the feed conveyor, thus reducing the travel distances of the spreading clips.

15 Claims, 16 Drawing Sheets

(56) References Cited

U.S. PATENT DOCUMENTS

| | | | | |
|---|---|---|---|---|
| 5,440,810 | A | 8/1995 | Borucki | |
| 5,515,627 | A * | 5/1996 | McCabe | D06F 67/04 38/143 |
| 8,732,995 | B2 * | 5/2014 | Herzog | D06F 67/04 38/143 |
| 2015/0284899 | A1 * | 10/2015 | Garrone | D06F 67/04 38/143 |

FOREIGN PATENT DOCUMENTS

| | | | |
|---|---|---|---|
| DE | 102009058637 | A1 | 6/2011 |
| EP | 2642019 | A1 | 9/2013 |
| EP | 3073009 | A1 | 9/2016 |
| WO | 2005038121 | A2 | 4/2005 |
| WO | 2009118643 | A1 | 10/2009 |

OTHER PUBLICATIONS

European Patent Office, Europaischer Teilrecherchenbericht (search in a related application), Jan. 29, 2018.
European Patent Office, Europaischer Recherchenbericht (search in a related application), Sep. 29, 2018.

* cited by examiner

METHOD AND APPARATUS FOR FEEDING ITEMS OF LAUNDRY TO A LAUNDRY TREATMENT DEVICE, PREFERABLY A MANGLE

STATEMENT OF RELATED APPLICATIONS

This patent application claims priority on and the benefit of German Patent Application No. 10 2016 011 676.5 having a filing date of 29 Sep. 2016.

BACKGROUND OF THE INVENTION

Technical Field

The invention relates to a method for feeding items of laundry to a laundry treatment device, preferably a mangle, wherein the items of laundry are supplied at a plurality of loading stations arranged next to one another, one item of laundry in each case is transferred by adjacent corner regions of a front edge to spreading clips of a spreading device, the spreading clips being moveable transversely with respect to the feeding direction of the item of laundry, and the front edge of the item of laundry is stretched by the spreading clips and centered with respect to the center of a feed conveyor.

The invention also relates to a method for supplying items of laundry to a laundry treatment device, in particular a mangle, wherein the front edge is stretched by a spreading device with spreading clips for holding adjacent corner regions of a front edge of the item of laundry and, in the process, the item of laundry is spread out, and also the spread-out item of laundry is deposited with a stretched front edge onto a feed conveyor.

The invention also relates to a method for feeding items of laundry to a laundry treatment device, preferably a mangle, wherein the items of laundry are supplied at at least one loading station, one item of laundry in each case is transferred by adjacent corner regions of a front edge to spreading clips of a spreading device, the spreading clips being moveable transversely with respect to the feeding direction of the item of laundry, and the front edge of the item of laundry is stretched by the spreading clips and centered with respect to the center of the feed conveyor.

Furthermore, the invention relates to an apparatus for feeding items of laundry to a laundry treatment device, in particular a mangle, with a feed conveyor transporting the items of laundry in the feeding direction to the laundry treatment device, a plurality of loading stations lying next to one another in a row running transversely with respect to the feeding direction, a pair of transfer clips, which is assigned to each loading station, with two transfer clips for taking over a respective item of laundry from the loading station assigned to them, and with a spreading device having spreading clips to which a transfer can be made from the transfer clips of adjacent corners of a front edge of the respective item of laundry.

Furthermore, the invention also relates to an apparatus for feeding items of laundry to a laundry treatment device, in particular a mangle, with a feed conveyor transporting the items of laundry in the feeding direction to the laundry treatment device, a spreading device, which is arranged upstream of said feed conveyor, for spreading out the respective item of laundry upstream of the feed conveyor, and at least one loading station upstream of the spreading device.

Furthermore, the invention also relates to an apparatus for feeding items of laundry to a laundry treatment device, in particular a mangle, with at least one loading station, a feed conveyor transporting the items of laundry in the feeding direction to the laundry treatment device, a spreading device, which is arranged upstream of said feed conveyor, for spreading out the respective item of laundry upstream of the feed conveyor, and at least one loading station upstream of the spreading device.

Furthermore, the invention also relates to an apparatus for feeding items of laundry to a laundry treatment device, in particular a mangle, with a feed conveyor transporting the items of laundry in the feeding direction to the laundry treatment device, a spreading device, which is arranged upstream of said feed conveyor, for spreading out the respective item of laundry upstream of the feed conveyor and depositing a spread-out front transverse edge region of the item of laundry onto at least one revolvingly drivable conveyor belt of the feed conveyor.

Furthermore, the invention also relates to an apparatus for feeding items of laundry to a laundry treatment device, in particular a mangle, with a feed conveyor transporting the items of laundry in the feeding direction to the laundry treatment device, a spreading device, which is arranged upstream of said feed conveyor, for spreading out the respective item of laundry upstream of the feed conveyor, and at least one loading station upstream of the spreading device.

Prior Art

Items of laundry are fed to laundry treatment devices, such as, for example, mangles, by apparatuses customarily referred to as insertion machines. Transverse edges, which are also referred to below as the front edge or rear edge, run here transversely with respect to the feeding direction.

It is known to spread out the items of laundry by a spreading device and, in the state spread out by the spreading device, to deposit same onto a feed conveyor or a depositing strip assigned to the latter. The spreading device has spreading clips which are moveable transversely with respect to the feeding direction, hold adjacent corners of a transverse edge, in particular of a front transverse edge, and stretch out or spread said transverse edge by moving apart. The item of laundry is still spread out here by the spreading device.

It is also known to place the items of laundry onto a plurality of loading stations arranged next to one another, with a portion of their transverse edge lying between the adjacent corners. The items of laundry are then transported from each loading station in the insertion direction to the insertion machine and the corners are transferred by transfer clips onto the spreading clips.

A disadvantage of the known insertion machines is a relatively great movement distance of the spreading clips from outer loading stations. A further disadvantage of known insertion machines is that the items of laundry which are placed by a central or close to central subregion of each front transverse edge onto the respective loading station can slip down in an uncontrolled manner from placing-on regions of the loading station. The same is true of a spread-out transverse edge region of the item of laundry deposited onto a front region of the feed conveyor by the spreading clips. Finally, the loading stations which are arranged in a positionally fixed manner upstream of the spreading device in the case of known insertion machines have an ergonomically unfavorable effect when placing regions of the items of laundry onto their placing-on points, even when mangles are waxed.

BRIEF SUMMARY OF THE INVENTION

The invention is based on the object of providing a method and an apparatus for feeding items of laundry to a laundry treatment device, in particular a mangle, which ensures a high treatment rate and reliable and ergonomically favorable operation.

A method for achieving this object is a method for feeding items of laundry to a laundry treatment device, preferably a mangle, wherein the items of laundry are supplied at a plurality of loading stations arranged next to one another, one item of laundry in each case is transferred by adjacent corner regions of a front edge to spreading clips of a spreading device, the spreading clips being moveable transversely with respect to the feeding direction of the item of laundry, and the front edge of the item of laundry is stretched by the spreading clips and centered with respect to the center of a feed conveyor, characterized in that the specific item of laundry is transferred to the spreading clips at a reduced distance from the center of the feed conveyor compared to outer loading stations. This method makes provision for items of laundry to be transferred from outer loading stations to the spreading clips at a reduced distance to the center of the feed conveyor in comparison to the outer loading stations. This shortens the travel distance of the spreading clips after taking over the respective item of laundry. This leads to shorter cycle times. In addition, the transfer of the items of laundry at a reduced distance from the center of the feed conveyor does not obstruct the transfer of items of laundry from a central loading station to the spreading device.

It is preferably provided that items of laundry are transferred to the spreading clips when spreading clips of a pair of spreading clips are brought together. This permits a space-saving transfer of the items of laundry to the respective pair of spreading clips.

Furthermore, it is preferably provided that the spreading clips for receiving the respective item of laundry are at a reduced distance from the center of the feed conveyor in comparison to outer loading stations, wherein said distance from the center of the feed conveyor corresponds at least to half the distance between the two spreading clips of a pair of spreading clips. That spreading clip of the pair of spreading clips which is directed towards the center of the feed conveyor is then spaced from the center of the feed conveyor by said half distance. As a result, spreading clips which take on items of laundry from eccentric loading stations do not interfere with the transfer of items of laundry from a central loading station.

An advantageous possibility of developing the method makes provision for the respective item of laundry to be transferred from a central loading station arranged between outer loading stations to a pair of spreading clips moved to the center of the feed conveyor. The spreading clips of outer loading stations do not interfere here despite this offset from the center of the feed conveyor because said spreading clips are moved up to the center of the feed conveyor only to the extent that space still remains for a central pair of spreading clips for indirectly or directly receiving a respective item of laundry from a central loading station.

An advantageous development of the method makes provision for the items of laundry to be transferred from or at the respective loading station to a moveable pair of transfer clips which moves the item of laundry to the relevant, in particular next, pair of spreading clips. At the end position of the pair of transfer clips, the respective item of laundry is then transferred by the latter to a pair of spreading clips. The respective pair of transfer clips can thus transfer the respective item of laundry from the eccentric loading station to a pair of spreading clips standing ready in the vicinity of and/or next to the center of the feed conveyor. Since a pair of spreading clips has taken over an item of laundry from the pair of transfer clips in the vicinity of the feed conveyor, but not in the center of the feed conveyor, the travel distances of the spreading clips for stretching out the front transverse edge and for the central centering of the item of laundry with stretched-out transverse edge are still relatively short. This reduces the cycle times.

A further possibility of the advantageous refinement of the method consists in moving the transfer clips of outer loading stations into end positions which are spaced less far away from the center of the feed conveyor than the relevant outer loading station. The distance between the center of a pair of transfer clips from the center of the feed conveyor is preferably 1 to 1½ times the distance of the transfer clips of the pair of transfer clips. As a result, the transfer clips can be moved as closely as possible to the center of the feed conveyor without obstructing the loading of other spreading clips with items of laundry originating, for example, from the central loading station.

An apparatus for achieving the object mentioned at the beginning is an apparatus for feeding items of laundry to a laundry treatment device, in particular a mangle, with a feed conveyor transporting the items of laundry in the feeding direction to the laundry treatment device, a plurality of loading stations lying next to one another in a row running transversely with respect to the feeding direction, a pair of transfer clips, which is assigned to each loading station, with two transfer clips for taking over a respective item of laundry from the loading station assigned to them, and with a spreading device having spreading clips to which a transfer can be made from the transfer clips of adjacent corners of a front edge of the respective item of laundry, characterized in that the transfer clips of outer loading stations are moveable on obliquely directed rails in the direction of a center of the feed conveyor, and the rails of the outer loading station end at a distance next to the center of the feed conveyor. In the case of this apparatus, transfer clips of outer loading stations are moveable on obliquely directed rails in the direction of the center of the feed conveyor, wherein the rails of the outer loading station end at a distance next to the center of the feed conveyor. As a result, the outer transfer clips can be moved close to the center of the feed conveyor in order to transfer items of laundry to the spreading clips. However, the transfer clips of outer loading stations are moved up to the center of the feed conveyor only to an extent such that they do not obstruct the transfer of items of laundry originating from the central loading station.

It is preferably provided that the rails which are arranged downstream of the outer loading stations run obliquely in the direction of the feed conveyor, preferably towards the center thereof and/or in an obliquely rising manner, as seen in the movement direction of the pairs of transfer clips. As a result, the items of laundry are not moved transversely with respect to the feeding direction by the pairs of transfer clips, but rather also in the feeding direction to the spreading device, which is located at a distance from the loading station, and are optionally or alternatively also raised in order to be able to transfer items of laundry which are relatively large in terms of surface area in spread-out form to the feed conveyor.

In an advantageous possibility of refining the apparatus, it is provided to provide the rails assigned to the outer loading stations with a certain length. The length is selected in such a manner that, for the transfer of items of laundry to the spreading clips, the pairs of transfer clips of the rails assigned to the outer loading stations are moveable to the spreading clips to an extent such that, when the items of laundry are transferred to the spreading clips, the centers of the pairs of transfer clips are spaced from the center of the feed conveyor only by 1 to 1½ times the distance of the respective pair of transfer clips. Also as a result, items of laundry can be transferred from the central loading station to a central pair of spreading clips independently of items of laundry which originate from the outer loading station.

An advantageous development of the apparatus makes provision for the pairs of transfer clips to move, as seen in the feeding direction, into an end position upstream of a respective pair of spreading clips, and/or for the spreading clips to be moveable along behind each pair of transfer clips which has been moved into the end position. The spreading clips can thus be moved as desired on their rails running transversely with respect to the feeding direction, specifically over the entire length of the rail, specifically even if at least one pair of transfer clips is moved into the end position in order to transfer an item of laundry to a pair of spreading clips.

Another apparatus for achieving the object, wherein a preferred development of the previously described apparatus may also be involved, is an apparatus for feeding items of laundry to a laundry treatment device, in particular a mangle, with a feed conveyor transporting the items of laundry in the feeding direction to the laundry treatment device, a spreading device, which is arranged upstream of said feed conveyor, for spreading out the respective item of laundry upstream of the feed conveyor, and at least one loading station upstream of the spreading device, characterized in that the respective loading station has a narrow loading conveyor with at least one revolving conveyor belt guided between deflecting drums and a supporting means supporting the deflecting drums, wherein the supporting means is designed in cross section in such a manner that it is insignificantly wider under the carrying run than opposite edges of the carrying run, and/or the supporting means is reduced with respect to the carrying run of the conveyor belt to the width of same. According thereto, each loading station has a narrow loading conveyor with at least one revolving conveyor belt guided between deflecting drums, and a supporting means supporting the deflecting drums. In the case of such a loading conveyor, it is provided to dimension the supporting means in cross section in such a manner that the latter is only insignificantly wider under the carrying run of the conveyor belt than opposite edges of the carrying run. As a result, that region of the item of laundry which is located in the region of the loading station is substantially supported only on the carrying run of the loading conveyor, but not or only insignificantly on the supporting means which is stationary in relation to the moving conveyor belt. This leads to better traction of that region of the item of laundry which rests on the conveyor belt. The item of laundry is thereby more reliably carried along by the revolvingly driven conveyor belt.

It is preferably provided that a deflecting drum of the loading conveyor, which deflecting drum is assigned in particular to a loading end of the respective loading conveyor and can optionally also serve at the same time as a drive drum, corresponds approximately to the width of the conveyor belt. The deflecting drum can be precisely the width of the conveyor belt, but can also be somewhat wider for tolerance reasons. Opposite end sides of the deflecting drum thus do not inhibit the traction of that part of the item of laundry resting on the carrying run of the conveyor belt at the start of the loading conveyor. The item of laundry is thereby carried along more reliably in the feeding direction by the revolvingly driven conveyor belt without there being the risk of that part of the item of laundry which rests on the carrying run of the loading conveyor sliding off from the conveyor belt.

A further apparatus for achieving the object mentioned at the beginning, wherein a preferred development of the previously described apparatus may also be involved, is an apparatus for feeding items of laundry to a laundry treatment device, in particular a mangle, with at least one loading station, a feed conveyor transporting the items of laundry in the feeding direction to the laundry treatment device, a spreading device, which is arranged upstream of said feed conveyor, for spreading out the respective item of laundry upstream of the feed conveyor, and at least one loading station upstream of the spreading device, characterized in that each loading station has a loading conveyor with two belt conveyors arranged one above the other, an upper belt conveyor leaves free a front part of a lower belt conveyor in order to form an placing-on region, and the front part of the lower belt conveyor forming the exposed placing-on region is adjustable. The latter makes provision for each loading station to have a loading conveyor consisting of two belt conveyors at least partially arranged one above the other. A lower belt conveyor protrudes forwards in relation to an upper belt conveyor in order to form a loading point or a placing-on region for a respective item of laundry. The front part of the lower belt conveyor is adjustable here. The front part of the lower belt conveyor forming the placing-on region is preferably pivotable and/or adjustable in height. By means of this adjustability, the placing-on region can be adjusted in height and, alternatively or additionally, also in inclination for adaptation to a respective operator. The latter can individually adjust the placing-on region. This contributes to improving the ergonomics of the apparatus.

An advantageous possibility of refining the apparatus makes provision for the front part of the lower belt conveyor forming and/or having the respective loading point or the respective placing-on region to be adjustable in relation to its rear part by pivoting. The rear part then forms a pivot axis about which the front part together with the front deflecting drum of the lower belt conveyor is pivotable. The front part together with the front deflecting drum of the lower belt conveyor is thereby changeable both in inclination and also in height.

A preferred possibility of developing the apparatus makes provision for the front deflecting drum of the upper belt conveyor, which front deflecting drum is set back in relation to the front deflecting drum of the lower belt conveyor, to be designed as a directing and/or tensioning drum of the carrying run of the lower belt conveyor. This front deflecting drum of the upper belt conveyor thereby has multiple functions. It forms at it were a bending point of the carrying run of the longer lower belt conveyor when the placing-on region thereof is pivoted upwards. In addition, the front deflecting drum of the upper belt conveyor tensions the at least one conveyor belt of the lower belt conveyor by abutting against the carrying run of the lower belt conveyor in the region of the pivot axis thereof. A particularly simple and effective adjustment of the height and/or inclination of the placing-on region of each loading station is thereby possible.

A further method for achieving the object mentioned at the beginning, wherein preferred developments of the previously described method may also be involved, is a method for supplying items of laundry to a laundry treatment device, in particular a mangle, wherein the front edge is stretched by a spreading device with spreading clips for holding adjacent corner regions of a front edge of the item of laundry and, in the process, the item of laundry is spread out, and also the spread-out item of laundry is deposited with a stretched front edge onto a feed conveyor, characterized in that a transverse edge region of the item of laundry starting from the front edge of the item of laundry is deposited with a wrap angle of more than 95° onto a front end of the feed conveyor. This method makes provision to deposit a front transverse edge region of the item of laundry with a wrap angle of more than 95° onto the feed conveyor, in particular its front deflecting drum and/or the adjoining front region of the carrying run of the preferably plurality of narrow conveyor belts of the feed conveyor lying next to one another. The front transverse edge region of the item of laundry deposited on the feed conveyor thereby obtains a frictionally locking connection sufficient for reliable carrying-along by the feed conveyor. Even relatively large items of laundry which still hang down with a large surface in front of the feed conveyor after the front edge region has been placed onto the start of said feed conveyor are reliably coupled in a frictionally locking and/or force-fitting manner by the wrapping of the front part of the feed conveyor by more than a quarter circle. The risk of relatively large items of laundry and items of laundry composed of relatively smooth materials also slipping down from the front end of the feed conveyor is thus reliably avoided.

It is preferably provided that the front transverse edge region of the respective item of laundry, spread out by the spreading clips and centered centrally, is deposited onto a front deflecting region of the preferably plurality of narrow conveyor belts of the feed conveyor lying next to one another. This depositing preferably takes place in such a manner that the item of laundry is deposited onto the front deflecting region of the feed conveyor in such a manner that the item of laundry lies against the deflecting drum with a wrap angle of more than 95°, preferably 100° to 140°. As a result, the item of laundry obtains a sufficient frictionally locking connection and/or force fit during the transfer onto the front region of the feed conveyor.

Another apparatus for achieving the object mentioned at the beginning, wherein a preferred development of the previously described apparatus may also be involved, is an apparatus for feeding items of laundry to a laundry treatment device, in particular a mangle, with a feed conveyor transporting the items of laundry in the feeding direction to the laundry treatment device, a spreading device, which is arranged upstream of said feed conveyor, for spreading out the respective item of laundry upstream of the feed conveyor and depositing a spread-out front transverse edge region of the item of laundry onto at least one revolvingly drivable conveyor belt of the feed conveyor, characterized in that a carrying run of the at least one conveyor belt of the feed conveyor runs inclined downwards by at least 5° to the horizontal in the feeding direction, at least in a front starting region, as seen in the feeding direction. The carrying run of the at least one conveyor belt of the feed conveyor runs here inclined downwards by at least 5° to the horizontal, as seen in the feeding direction, at least in a front starting region, as seen in the feeding direction, onto which the front transverse edge of the item of laundry is placed. By means of the downwardly inclined starting region of the carrying run of the feed conveyor, the wrap angle of the narrow front transverse edge region, to be deposited thereon, of a respective item of laundry is increased, specifically beyond a quarter circle region.

It is preferably provided that the carrying run of the at least one conveyor belt of the feed conveyor runs in an inclined manner in the feeding direction over an angle of 10° to 15° to the horizontal at least in the starting region. This leads to particularly effective coupling of the front edge region to the feed conveyor, in particular in the region of the front deflecting drum of same if said front edge region is deposited onto the feed conveyor by the spreading clips. As a result, the risk of the front edge region of an item of laundry slipping down from the feed conveyor, especially in the case of relatively large items of laundry, is eliminated.

A further method for achieving the object mentioned at the beginning and/or for the advantageous development of the methods furthermore mentioned and claimed is a method for feeding items of laundry to a laundry treatment device, preferably a mangle, wherein the items of laundry are supplied at at least one loading station, one item of laundry in each case is transferred by adjacent corner regions of a front edge to spreading clips of a spreading device, the spreading clips being moveable transversely with respect to the feeding direction of the item of laundry, and the front edge of the item of laundry is stretched by the spreading clips and centered with respect to the center of the feed conveyor, characterized in that the at least one loading station can be shifted as required in order to provide operators with access to a front depositing region of the feed conveyor. This method can also be an advantageous development of the previously described methods. The method makes provision for at least the or each loading station to be extended when required, if an operator is intended to obtain free access to the front feeding end of the feed conveyor. The at least one loading station is preferably pivoted upwards. It is thus possible for one or else a plurality of operators to place an "oil cloth" manually onto the input end of the feed conveyor for the purpose of waxing a mangle arranged downstream of the feed conveyor, without the at least one loading station upstream of the feed conveyor causing a disturbance as a result.

A preferred development of the method makes provision for not only the at least one loading station, but also the spreading device and optionally the or each pair of transfer clips together with the movement rail assigned thereto to be pivoted upwards together as a unit, and therefore the spreading device and the at least one optionally provided pair of transfer clips with the associated movement rail also do not cause a disturbance when the "oil cloth" is placed manually onto the placing-on end of the feed conveyor. Conversely, after the end of the waxing of the mangle, the at least one loading station of the spreading device and optionally the at least one pair of transfer clips together with its rail are pivoted back together into their initial position and operating position.

A further apparatus for achieving the object mentioned at the beginning, in which a preferred development of the previously described apparatus can also be involved, is an apparatus for feeding items of laundry to a laundry treatment device, in particular a mangle, with a feed conveyor transporting the items of laundry in the feeding direction to the laundry treatment device, a spreading device, which is arranged upstream of said feed conveyor, for spreading out the respective item of laundry upstream of the feed conveyor, and at least one loading station upstream of the spreading device, characterized in that at least one loading station, the spreading device and at least one pair of transfer clips are arranged on a common pivoting device and are pivotable together by the pivoting device in order to provide an operator with free access to a front end of the feed conveyor. According thereto, it is provided to arrange the at least one loading station and/or the spreading device and/or the at least one pair of transfer clips together with the rail assigned thereto on a common pivoting device. This pivoting device permits joint pivoting of the at least one loading station, optionally also the spreading device and/or the at least one pair of transfer clips together with the associated rail. The mentioned components of the apparatus can be pivoted upwards for free axis to the placing-on end of the feed conveyor and can subsequently be pivoted back again into the operating position. This especially facilitates the manual waxing of a mangle arranged downstream of the feed conveyor or makes it possible at all.

BRIEF DESCRIPTION OF THE DRAWINGS

Preferred exemplary embodiments of the invention are explained in more detail below with reference to the drawings, in which.

DETAILED DESCRIPTION OF PREFERRED EMBODIMENTS

Figure 1:
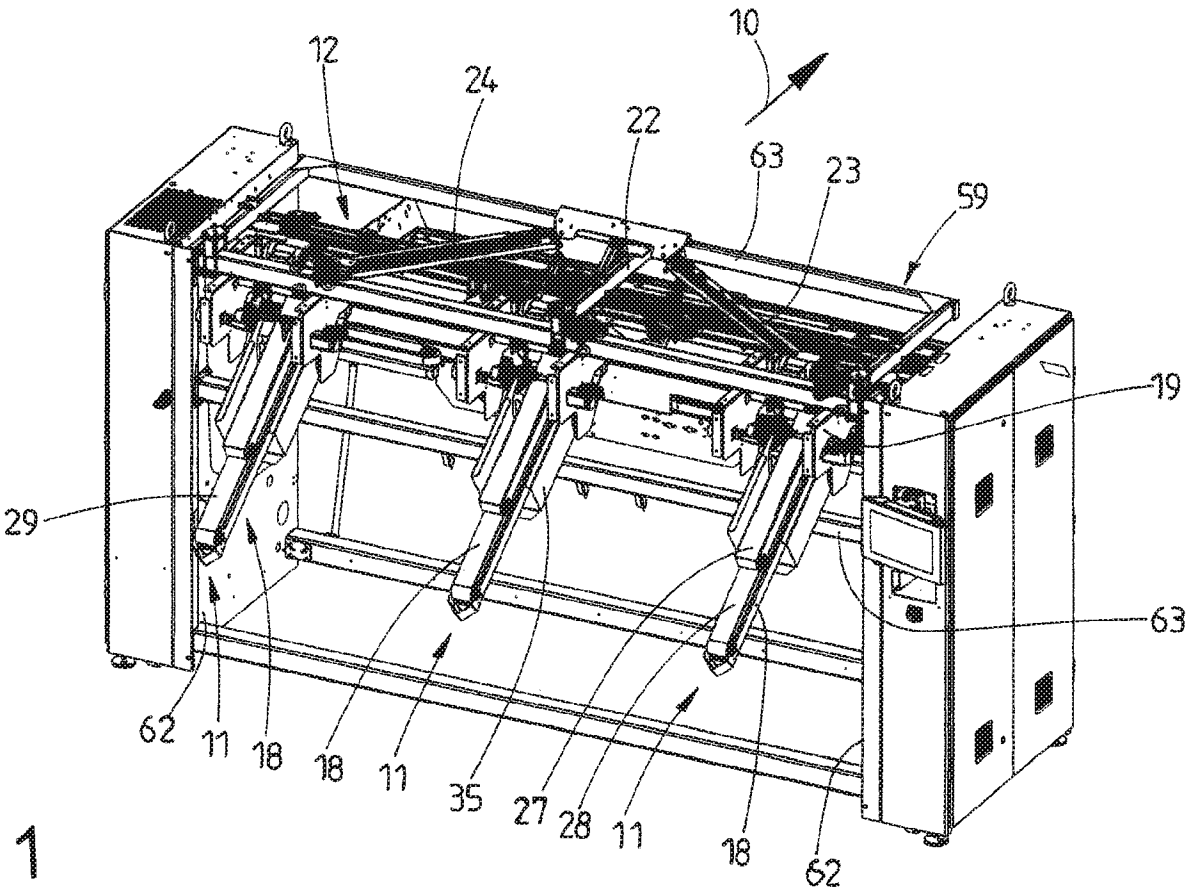
FIG. 1 shows a perspective overall view of an apparatus designed as an insertion machine.

The figures show an apparatus designed as an insertion machine. This insertion machine is fully illustrated in FIGS. 1 to 5. The insertion machine serves to feed items of laundry (not illustrated), specifically especially flat items of laundry, such as bed sheets, bed covers, pillow covers, hand towels, table cloths and the like, in feeding direction 10 to a mangle (not shown in the figures). The apparatus can also serve to feed items of laundry to other laundry treatment devices, for example folding machines.

The apparatus or insertion machine illustrated here has three identically designed loading stations 11. The three loading stations 11 are arranged at an equal distance from one another in a row running transversely with respect to the feeding direction 10 on the front side of the insertion machine. In the case of the insertion machine shown, the central loading station 11 is located in the center thereof. The two other loading stations 11 are arranged eccentrically on opposite sides of the central loading station 11 at an equal distance in each case from the central loading station 11. The invention is also suitable for insertion machines with a greater or smaller number of loading stations 11, specifically also for insertion machines with only a single loading station 11.

The loading stations 11 are followed by a spreading device 12, as seen in the feeding direction 10. The spreading device 12 has a horizontal rail 13 which runs transversely with respect to the feeding direction 10 and on which moving carriages 15, in each case carrying a spreading clip 14, are moveable transversely with respect to the feeding direction 10. In the case of the apparatus shown, four preferably identically designed spreading clips 14 are provided with a dedicated moving carriage 15 in each case. However, it is also conceivable for the spreading device 12 to have only two or more than four spreading clips 14. In each case two spreading clips 14 with a mirror-inverted arrangement with respect to each other form a pair of spreading clips for adjacent corners of a transverse edge of the item of laundry moving ahead in the feeding direction 10. The spreading clips 14 of each pair can be brought together and moved apart transversely with respect to the feeding direction 10. In the brought-together state, the two spreading clips 14 of a pair take over adjacent corners of the front transverse edge of an item of laundry. By lateral movement and movement apart of the spreading clips 14 of the respective pair of spreading clips, the front transverse edge of the item of laundry is spread or stretched in order to spread out the item of laundry under the spreading device 12. In addition, the item of laundry is centered by the spreading clips 14 of the respective pair of spreading clips in relation to the center of the apparatus.

A feed conveyor 17 follows the spreading device 12, as seen in the feeding direction 10. The item of laundry spread out and centered by the spreading device 12 is transferred by a stretched transverse edge moving ahead onto a front end 16 of the feed conveyor 17 by the spreading clips 14 of the pair of spreading clips. This takes place by central depositing of a front stretched transverse edge region of the item of laundry onto that portion of a carrying run of the feed conveyor 17 which is located in the front end 16 of the feed conveyor 17. The center of the item of laundry is deposited here in the center of the feed conveyor 17. The center of the feed conveyor 17 lies in a vertical longitudinal center plane of the insertion machine, said plane running in the feeding direction 10.

The feed conveyor 17 is used to transport the item of laundry lying spread-out and/or stretched-out thereon to the mangle (not shown in the figures) or to another laundry treatment device.

Figure 5:
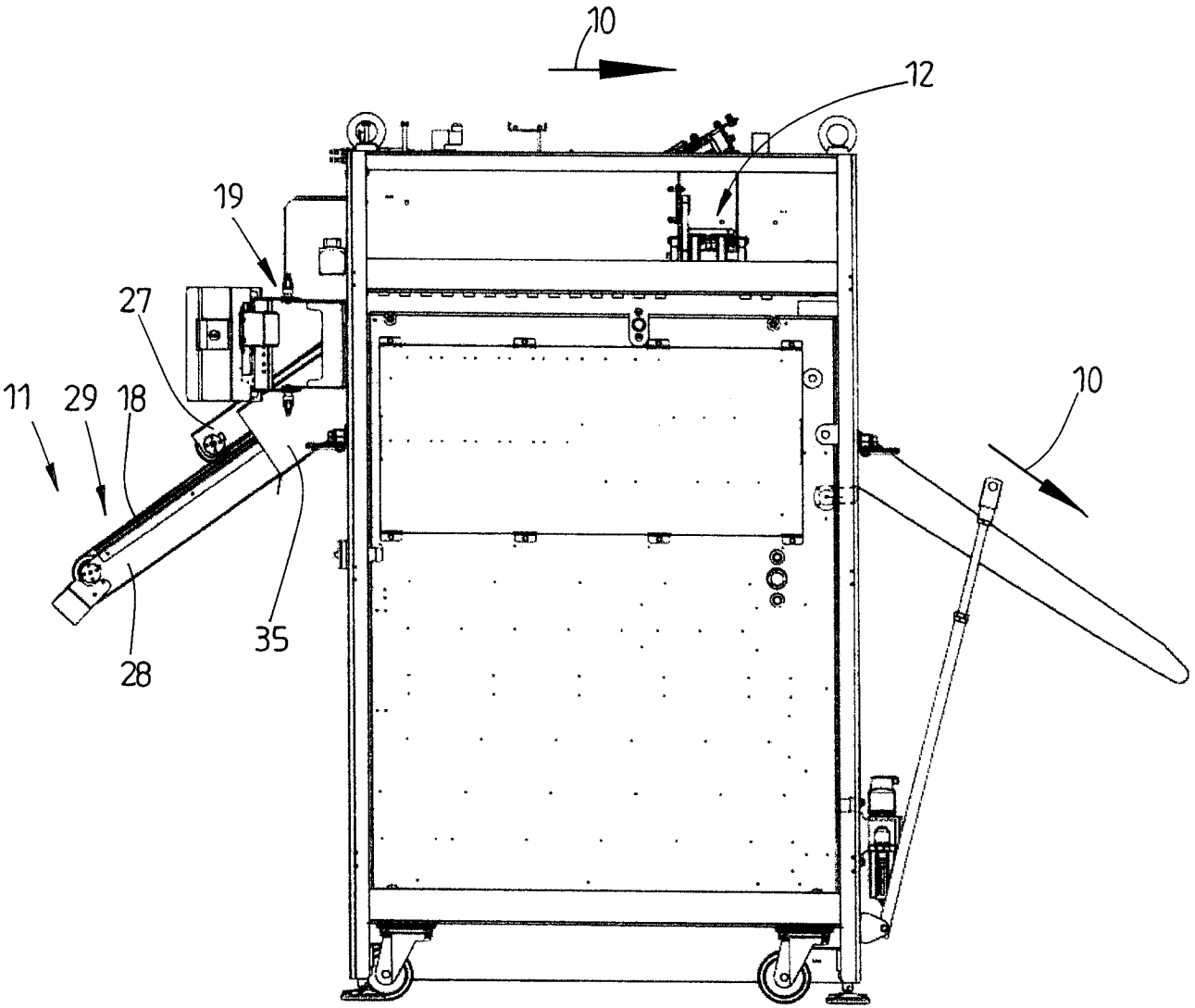
FIG. 5 shows a side view of the insertion machine of FIG. 1.
Figure 6:
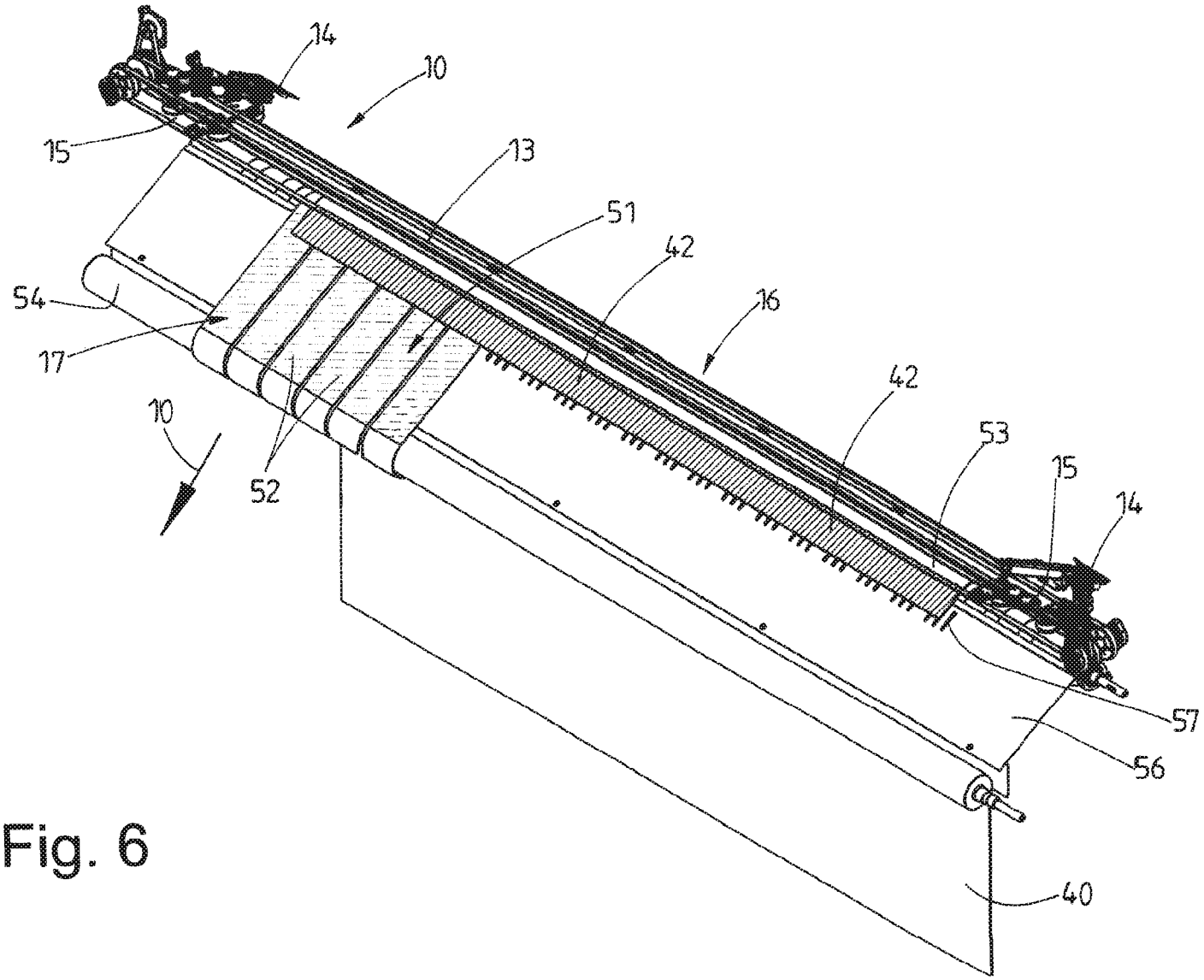
FIG. 6 shows a rear view of a spreading device and of a feed conveyor.
Figure 7:
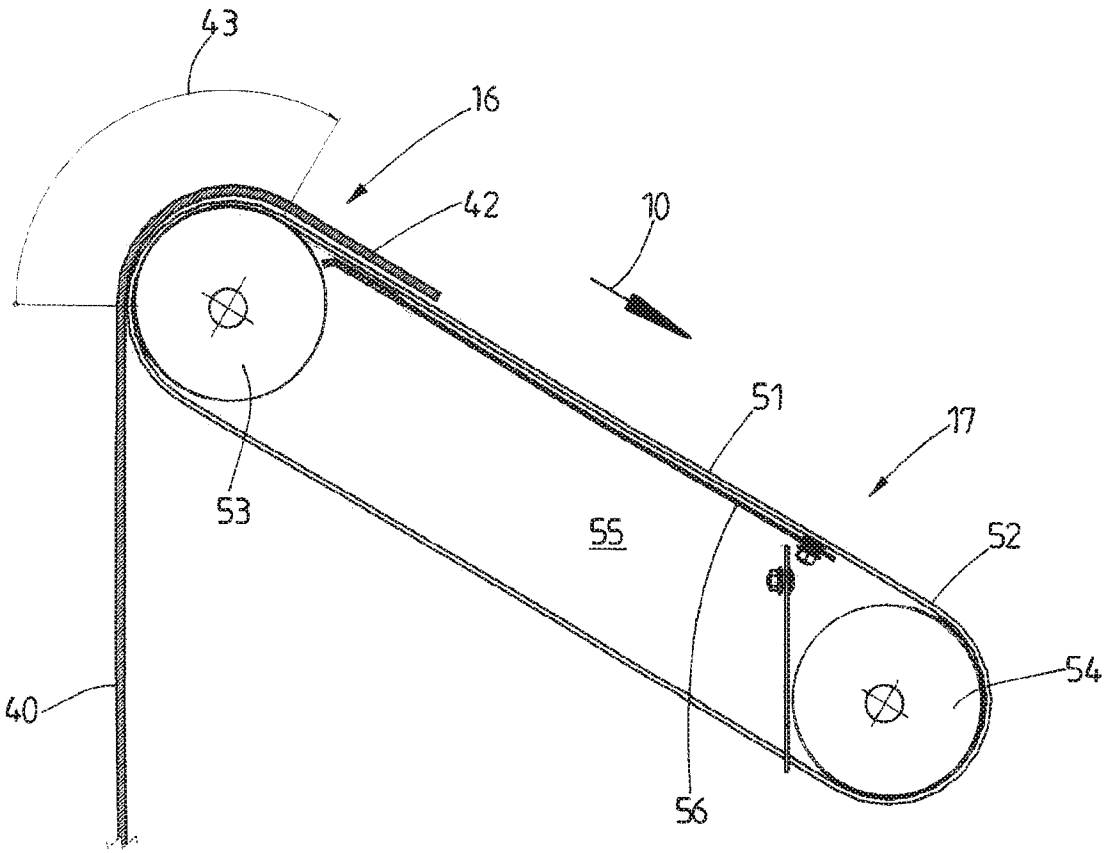
FIG. 7 shows an enlarged cross section through the feed conveyor of FIG. 6.
Figure 8:
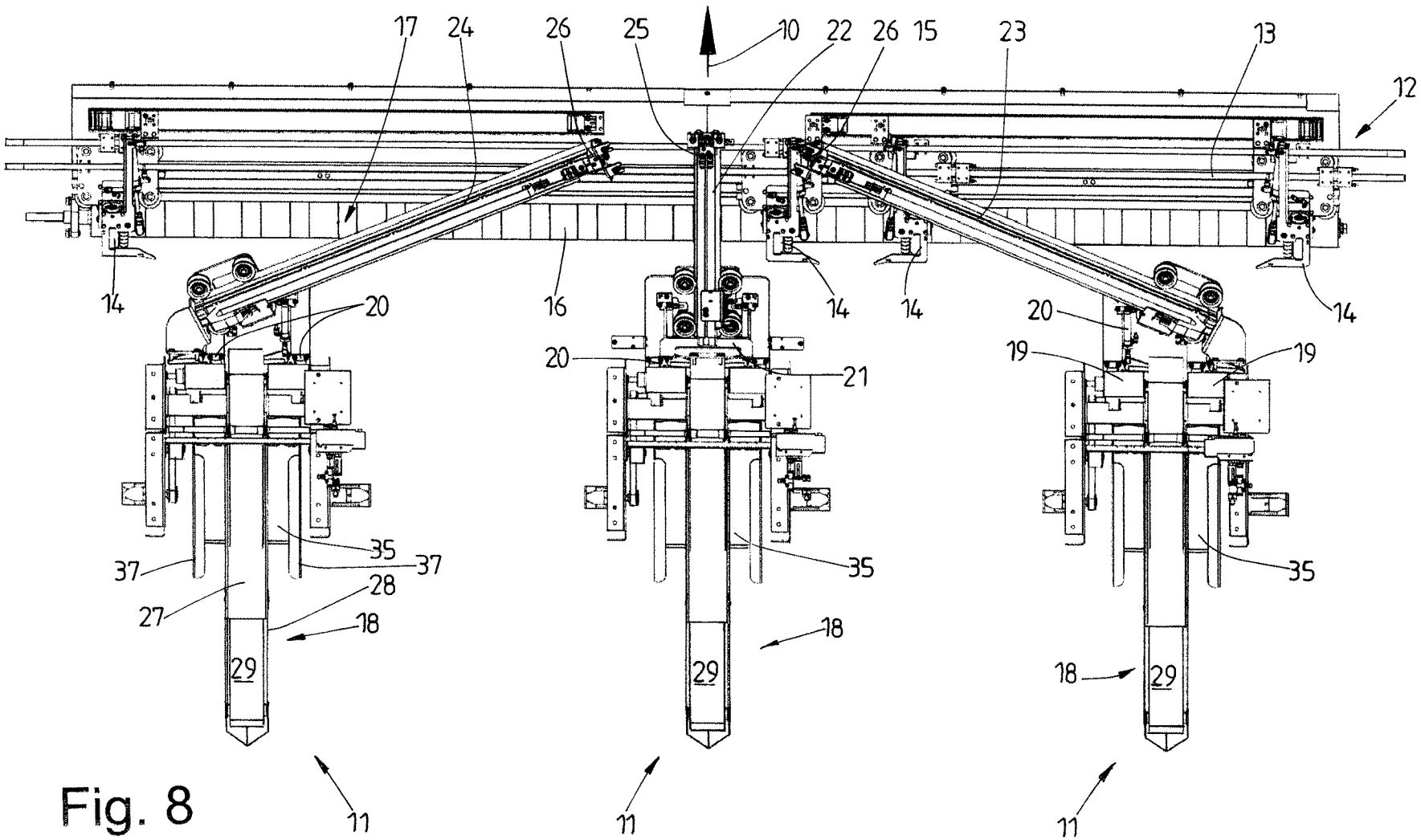
FIG. 8 shows a top view of the partially illustrated insertion machine of FIG. 1 in a basic position.

The feed conveyor 17 runs in a downwardly inclined manner from its front end 16 in the feeding direction 10, i.e. in the direction of the laundry treatment device (FIGS. 5 to 7). As a result, the carrying run 51 which, in the case of the feed conveyor 17 shown, is formed from a plurality of narrow revolving conveyor belts 52 lying next to one another at a small distance, is likewise inclined downwards in the feeding direction 10. According to the illustration in particular of FIG. 7, the carrying run 51 runs from a deflecting drum 53 at the front end 16 of the feed conveyor 17 at an angle 30° to the horizontal to a rear, lower deflecting drum 54 following downstream, as seen in the feeding direction 10.

As a result of the obliquely downwardly directed profile of at least the carrying run 51 of the feed conveyor 17, an item of laundry 40 placed onto the front end region 16, which starts from the front end 16 at the front deflecting drum 53, of the carrying run 51 of the feed conveyor 17 by a respective pair of spreading clips of the spreading device 12 enters with a front transverse edge region 42 at the angle 43 of 120°, which is shown in FIG. 7, in relation to the trailing part of the item of laundry 40 which is still hanging vertically downwards in the stretched-out state upstream of the front end 16 of the feed conveyor 17. The transverse edge region 42 of the item of laundry 40 thus lies at a wrap angle of 120°, corresponding to the angle 43, against the portion, deflected about the deflecting drum 53, of the conveyor belts 52, lying next to each other, of the feed conveyor 17. Said wrap angle of more than 90° leads to an improved frictionally locking connection between the conveyor belts 52 and the front transverse edge region 42 of the item of laundry 40, thus eliminating the risk of sliding down of the item of laundry 40 which rests only with the narrow front transverse edge region 42 on the conveyor belts 52 after the item of laundry 40 is placed onto the front end 16 of the feed conveyor 17.

Between the deflecting drums 53 and 54, the feed conveyor 17 illustrated has a suction box 55 arranged below the carrying run 51. A front part of the carrying run 51 of the feed conveyor 17 runs along on a top wall 56, which is provided with perforations 57, of the suction box 55. As a result of the conveyor belts 52 being of air-permeable design, that region of the item of laundry 40 which is located behind the front deflecting drum 53 is firmly sucked with a slight negative pressure onto the carrying run 51. This leads to an additional frictionally locking and/or force-fitting fixing of the item of laundry 40, in particular of its transverse edge region 42, on the carrying run 51 of the feed conveyor 17. However, the invention is not limited to the additional sucking fixing of the items of laundry 40 on the feed conveyor 17. Especially in the case of a larger front deflecting drum 53, it may suffice by itself if the front transverse edge region 42 of the item of laundry 40 is fixed in a frictionally locking manner only via a wrap angle of approximately 120° in the region of the front deflecting drum 53 of the feed conveyor 17.

The wrap angle 43 is not restricted to the 120° shown. It can be larger or smaller. However, the wrap angle 43 should be at least 95°. It can also be larger than 120°, for example up to 140°.

Each loading station 11 has a loading conveyor 18 which transports the item of laundry in the feeding direction 10, and two following corner finders 19 for respectively adjacent corners or corner regions of a second, originally rear transverse edge of the item of laundry.

In the case of the apparatus or insertion machine illustrated, transfer clips 20 are provided between the two corner finders 19 of each loading station 11 and the spreading device 12. The two transfer clips 20 assigned in each case to a corner finder of each loading station 11 are combined to form a pair of transfer clips 21. The transfer clips 20 or the pair of transfer clips 21 thereby form a double clip for in each case one of the opposite corners of the transverse edge of the item of laundry.

The pair of transfer clips 21 of each loading station 11 is moveable on a rail 22, 23, 24 with a moving carriage. The rail 22 of the central loading station 11 runs rectilinearly in the feeding direction 10 along the center of the insertion machine and of the feed conveyor 17. The rail 22 runs directed upwards in the feeding direction 10.

Figure 11:
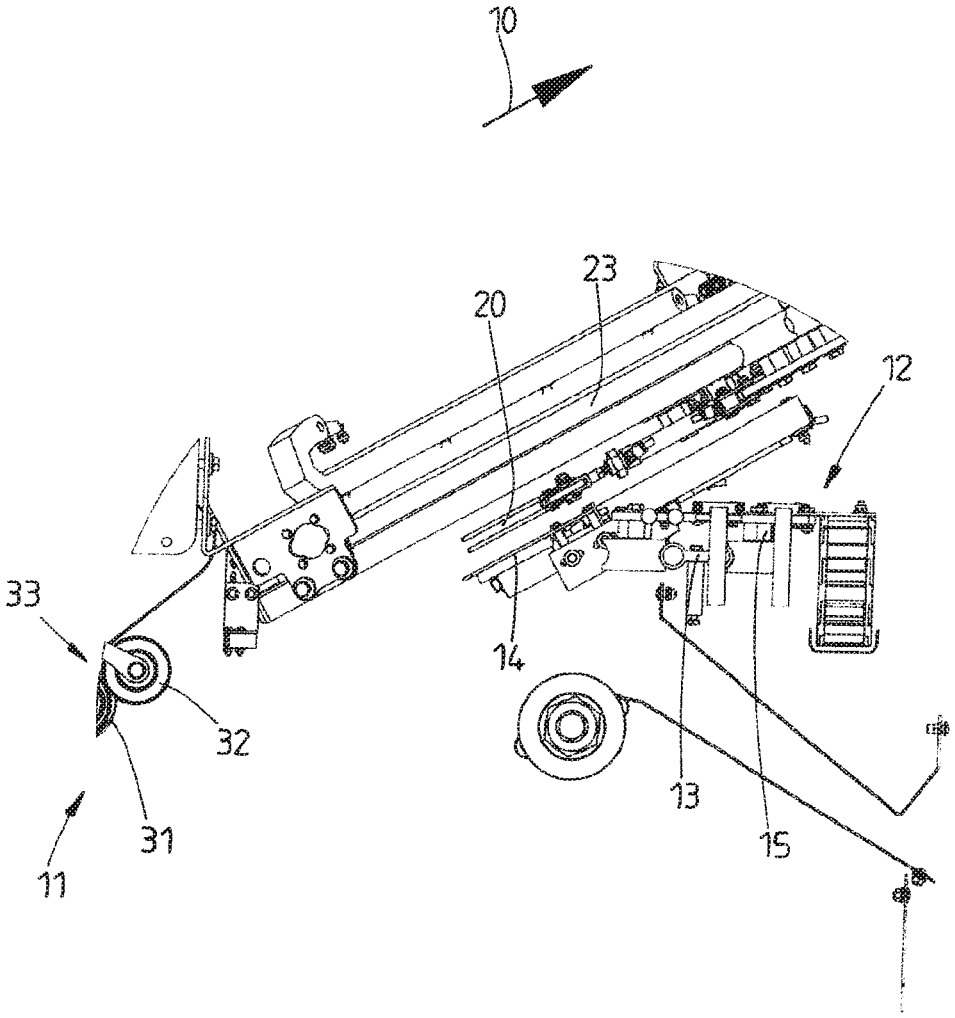
FIG. 11 shows a partially illustrated side view of the insertion machine of FIG. 10 analogously to FIG. 9.

Longer rails 23, 24 which run obliquely upwards and in the direction of the spreading device 12 emerge from the outer loading stations 11. The two rails 23, 24 are identical in length, but directed differently, and therefore their rear ends 25, as seen in the feeding direction 10, are directed in a converging manner towards the center of the insertion machine, but end before the center. The ends 25 of the rails 23 and 24 are spaced apart from the end 26 of the central rail 22, specifically by approximately more than the width of a pair of transfer clips 21. The ends 25, 26 of the rails 22, 23 and 24 lie on a common horizontal (imaginary) line which runs parallel to the rails 13 of the spreading device 12, but at a distance in front of and/or above the latter. The lengths of the rails 22, 23 and 24 and the positioning of their ends 25, 26 are undertaken here in such a manner that the spreading clips 14 can run past the transfer clips 20 without collision, specifically behind the transfer clips 20, as seen in the feeding direction 10, in the exemplary embodiment shown (FIG. 11).

Each of the identically designed loading conveyors 18 of the loading station 11 has two narrow belt conveyors 27, 28 which are identical in width and each have at least one revolving conveyor belt. The belt conveyors 27, 28 are arranged one above the other in order to form a sandwich conveyor. The upper belt conveyor 27 is shorter than the lower belt conveyor 28, wherein the upper belt conveyor 27 lies behind the start of the lower belt conveyor 18, as seen in the feeding direction 10, in order to form an exposed front region of a carrying run 39 of the lower belt conveyor 28, said region thus forming a placing-on region 29 for a respective item of laundry 40.

Figure 14:
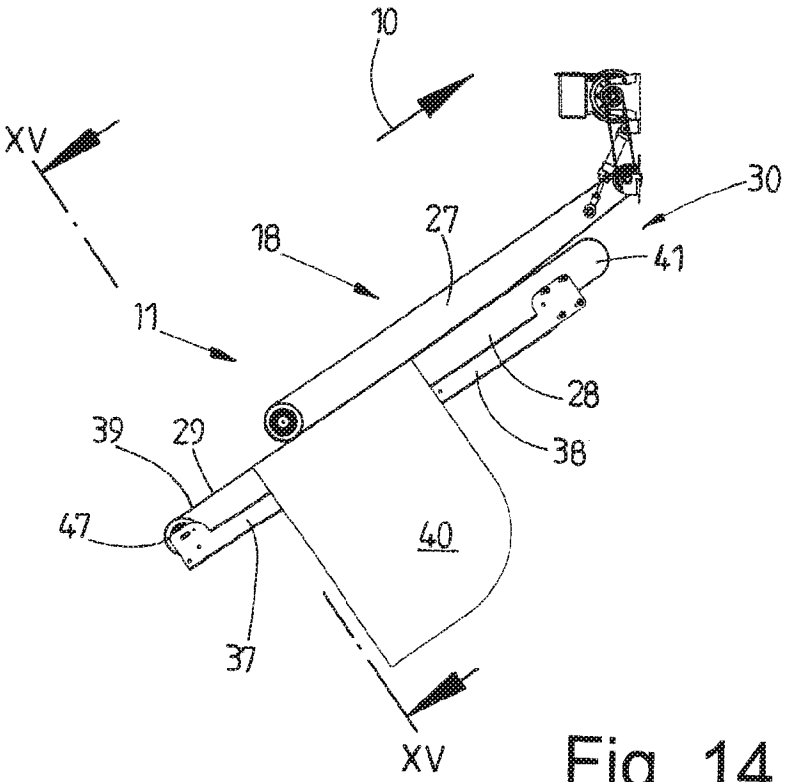
FIG. 14 shows a side view of the loading station of FIG. 13.
Figure 13:
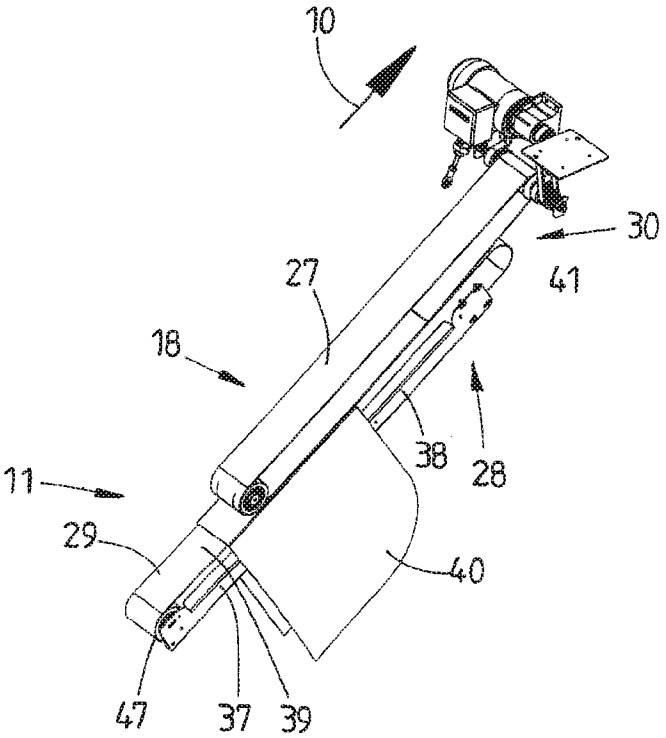
FIG. 13 shows a perspective illustration of a loading station of the insertion machine of FIGS. 1 to 12.
Figure 16:
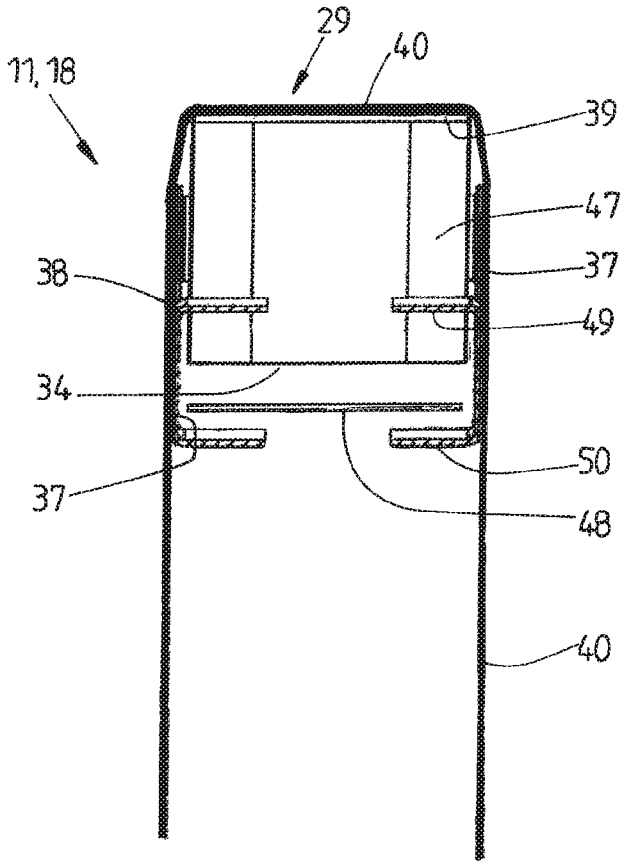
FIG. 16 shows the cross section of FIG. 15 with an item of laundry suspended on the placing-on region.

For loading the insertion machine in the region of the respective loading station 11, an ideally central, narrow transverse edge portion located between adjacent corners of the front transverse edge of the item of laundry 40 is placed onto the placing-on region 29 of the lower belt conveyor 28 (FIGS. 13, 14, 16).

Preferably only the shorter upper belt conveyor 27 is driven, specifically, for example, at a deflecting drum at the rear end of the belt conveyor 27, as seen in the feeding direction 10. The conveyor belt of the longer lower belt conveyor 28 is indirectly driven by carrying along by the conveyor belt of the driven shorter belt conveyor 27 or a part of an item of laundry 40 located between the carrying run 39 of the lower belt conveyor 28 and the return run of the upper belt conveyor 27.

Figure 15:
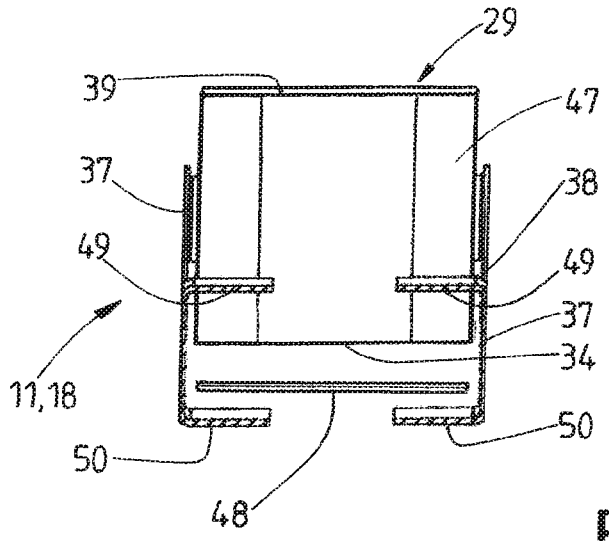
FIG. 15 shows a cross section XV-XV from FIG. 14 through a placing-on region of a loading station.

The lower belt conveyor 28 is provided with a supporting means 38 for supporting its rotatable front deflecting drum 47 and its rear deflecting drum 41. According to the invention, the supporting means 38 is designed to be insignificantly wider than the front or lower deflecting drum 47 of the belt conveyor 28 (FIGS. 15 and 16). The width of the supporting means 38 on outer opposite sidewalls 37 is preferably only 4% to 20%, preferably 5% to 12%, wider than the width of the front deflecting drum 47. As a result, the item of laundry 40 which is placed in an approximately U-shaped manner by an inner, preferably approximately central, portion of the front transverse edge region on the placing-on region 29 of the belt conveyor 28 fits tightly against the opposite end sides 36 of the lower deflecting drum 47.

In addition, the sidewalls 37 of the supporting means 38 are only provided with a reduced height which is smaller than the distance between the runs of the lower belt conveyor 28 and preferably lies in the vicinity of the lower side of the cylindrical circumferential surface 34 of at least the front deflecting drum 47 (FIGS. 15 and 16). Between the deflecting drums 41, 47, opposite sidewalls 37 of the supporting means 38 are of still lower design by lying under an axis of rotation 58 of the front deflecting drum 47 (FIGS. 15 and 16). In the exemplary embodiment shown, the upper longitudinal edges of the opposite sidewalls 37 of the supporting means 38 are located approximately by ¾ of the diameter of the deflecting drum 47 below the placing-on region 29 of the lower belt conveyor 28, said placing-on region being formed by the carrying run 39. As a result, longitudinal edge regions of the item of laundry 40 hanging down from the placing-on region 29 on both sides only come into contact with narrow lower portions of the sidewalls 37 of the supporting means 38.

The narrow sidewalls 37 of the supporting means 38 of the belt conveyor 28 that lie as closely together as possible and are reduced in height mean that the sidewalls 37 exert only very low supporting forces on the longitudinal and sidewall regions of the item of laundry 40 that hang down on both sides from the placing-on region 29. This gives rise to only very low frictional forces between the item of laundry 40 and the sidewalls 37 of the supporting means 38, said frictional forces scarcely opposing the frictional force of that part of the item of laundry 40 which rests in the placing-on region 29 on the carrying run 39 of the belt conveyor 28 and thereby only insignificantly reduces said frictional force. This leads to an effective frictionally locking and/or force-fitting coupling and carrying along of the item of laundry 40 by the carrying run 39 of the belt conveyor 28 in the placing-on region 29. A risk of the front side of the item of laundry 40 sliding down from the placing-on region 29 before reaching the region of influence of the upper belt conveyor 27 is thereby avoided.

In a departure from the exemplary embodiment illustrated, it is conceivable to allow the opposite sidewalls 37 of the supporting means 38 to run approximately obliquely in opposite directions such that they slightly converge towards the placing-on region 29 of the lower belt conveyor 28. This leads to a further reduction in the frictional force between the opposite sidewall regions of the item of laundry 40 hanging down on both sides from the placing-on region 29 and thereby to an even greater frictionally locking and/or force-fitting coupling of said item of laundry to the carrying run 39 in the placing-on region 29 of the belt conveyor 28.

Between the deflecting drums 41 and 47, upper and lower edges of the sidewalls 37 of the supporting means 38 are provided with upper edge strips 49 and lower edge strips 50 which are preferably angled at right angles in relation to the sidewalls 37. The edge strips 49 and 50 are angled inwards between the sidewalls 37 and each have a width which is smaller than half the spacing of the sidewalls 37, and therefore a central clearance remains between the free ends of the edge strips 49 and 50 that are directed towards each other. Formed between the edge strips 49 and 50 is a chamber which for the most part is located below the deflecting drums 41 and 47 and serves for receiving a return run 48, which returns empty, of the revolving endless conveyor belt of the lower belt conveyor 28. In said chamber, the return run 48 of the conveyor belt can run along unimpaired by the sidewall regions of the item of laundry 40 hanging down on opposite sides of the lower belt conveyor 28 (FIGS. 15 and 16).

Figure 17:
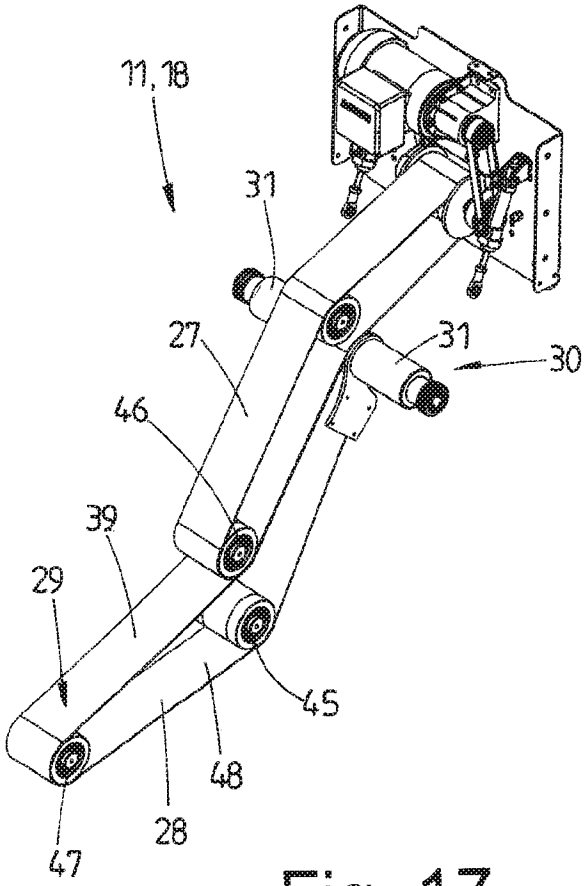
FIG. 17 shows a perspective illustration of a loading station.

FIGS. 15 and 17 furthermore clarify that the width of the revolving conveyor belt of the lower belt conveyor 28 corresponds to the width of at least the front deflecting drum 47 or is optionally slightly narrower.

Figure 18:
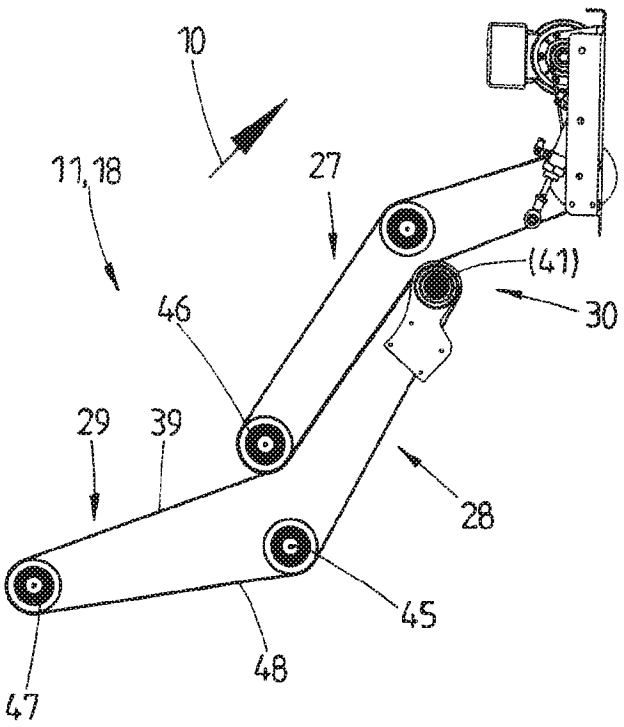
FIG. 18 shows a side view of the loading station of FIG. 17.

According to the invention, the placing-on region 29 of each loading conveyor 18 is adjustable. FIGS. 17 to 18, on the one hand, and FIGS. 19 and 20, on the other hand, show various adjustment positions of the placing-on region 29 of a loading conveyor 18. The placing-on regions 29 of other loading conveyors 18 are adjustable in the same manner.

In the exemplary embodiment shown here, the placing-on region 29 of the respective loading conveyor 18 is adjusted by a change in height of the front deflecting drum 47 of the lower belt conveyor 28 of the loading conveyor 18, said front deflecting drum being located at the start of the placing-on region 29.

A preferably freely rotatable deflecting pulley 45 is assigned to a return run 48 of the revolving conveyor belt of the lower belt conveyor 28. The deflecting pulley 45 is positioned over the return run 48, specifically approximately centrally between the deflecting drums 41 and 47 of the belt conveyor 28. As a result, when moving the front deflecting drum 47 upwards, the deflecting pulley 45 is pressed from above against the return run 48, as a result of which the latter attains an increasingly V-shaped configuration.

The deflecting drum 47 is preferably pivotable on a circular path with a circle center point on the deflecting pulley 45. For this purpose, the deflecting drum 47 and the deflecting pulley 45 are mounted on a common supporting member, and are preferably connected to two parallel pivot arms (not illustrated in the figures). The longitudinal center axis and axis of rotation of the deflecting pulley 45 serves here as a pivot axis for the pivoting arms.

At the end of the placing-on region 29, i.e. between the deflecting drums 41 and 47 of the lower belt conveyor 28, the carrying run 39 of the conveyor belt of the lower belt conveyor 28 is assigned a front deflecting drum 46 of the upper belt conveyor 27. Since said front deflecting drum lies above the lower belt conveyor 28, said deflecting drum 46 of the upper belt conveyor 27 presses onto the carrying run 39 of the lower belt conveyor 28. In the case of the loading conveyor 18 illustrated in FIGS. 17 to 20, the front deflecting drum 46 of the upper belt conveyor 27 is located somewhat above the deflecting pulley 45 above the return run 48 of the lower belt conveyor 28. However, the front deflecting drum 46 of the upper belt conveyor 27 can also lie in front of and behind the deflecting pulley 45.

Figure 20:
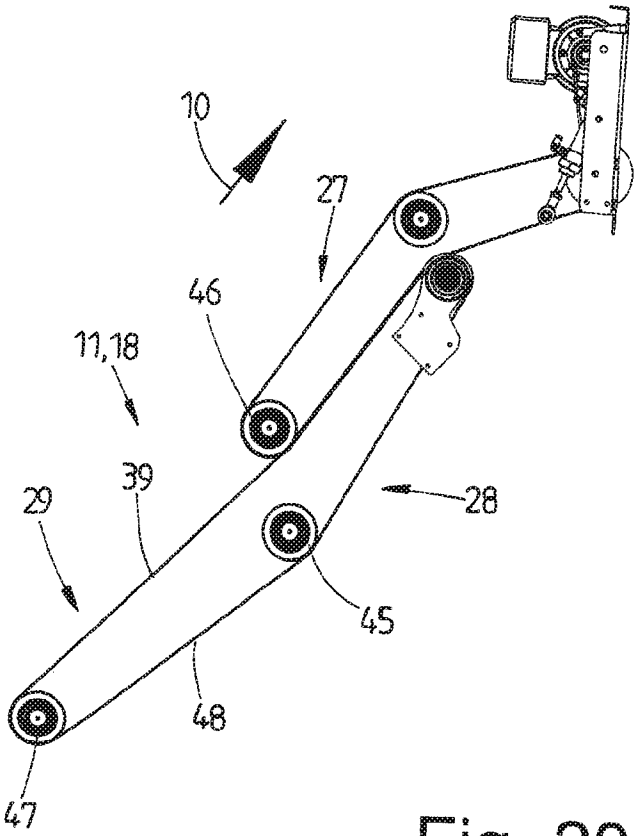
FIG. 20 shows a side view of the loading point of FIG. 19.

By means of the above-described assignment of the front deflecting drum 46 of the upper belt conveyor 27 to the carrying run 39 of the lower belt conveyor 28, the deflecting drum 46 serves at the same time to tension the carrying run 39 of the conveyor belt of the lower belt conveyor 28 during the movement of the front deflecting drum 47 of the belt conveyor 28 up and down, which takes place in order to adjust the placing-on region 29 of the loading conveyor 18 (cf. FIGS. 18 and 20).

Figure 19:
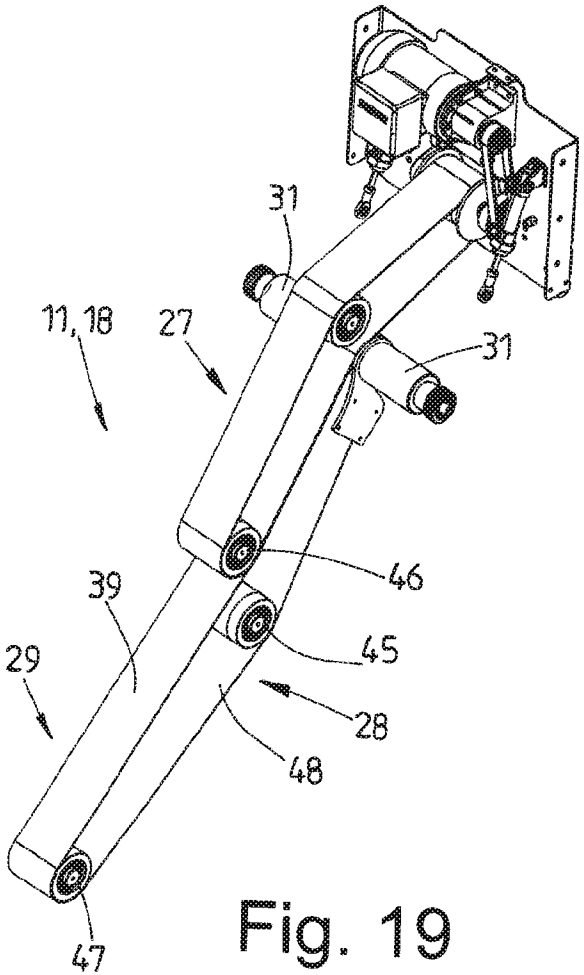
FIG. 19 shows a perspective illustration of the loading station of FIG. 17 with the placing-on region positioned higher.

By means of the above-described adjustability of the loading conveyor 18, the starting regions of the placing-on regions 29 of the loading conveyors 18, which starting regions are defined by the front deflecting drums 47 of the lower belt conveyors 28, are adjustable in height independently of one another. In addition, the inclination of the respective placing-on region 29 can thereby be changed. When the respective deflecting drum 47 is pivoted upwards, the inclination of the respective placing-on region 29 is reduced by the placing-on region 29 rising less sharply, as seen in the feeding direction 10 (FIGS. 17 and 18), than in the case of the front deflecting drum 47 which has been pivoted downwards and reduced in height (FIGS. 19 and 20).

The corner finders 19 of the respective loading station 11 are assigned to a rear end 30 of the lower belt conveyor 28, as seen in the feeding direction 10, specifically on both sides next to the rear end 30 of the belt conveyor 28 and partially behind the latter. Each of the preferably identically designed corner finders 19, which are, however, oriented in a mirror-inverted manner by being arranged on opposite sides of the end 30 of the belt conveyor 28, has two rollers 31, 32 which together form a pair of rollers with parallel longitudinal center axes or axes of rotation. A roller nip 33 is formed between the rollers 31, 32 of the pair of rollers.

One roller 31 of each corner finder 19 is drivable in a rotating manner. Said rollers 31 which are each driven separately and independently of one another on both sides of the deflecting drum 41 at the rear end 30 of the belt conveyor 28 lie on a common line transversely with respect to the feeding direction 10. The axes of rotation of the driven rollers 31 and of the deflecting drum 41 of the belt conveyor 28 lie on said line.

The driven rollers 31 are arranged in a fixed position in precisely the same manner as the deflecting drum at the end 30 of the belt conveyor 28. By contrast, the rollers 32 are mounted moveably on a pendulum arm.

At somewhat a distance behind the start of the upper belt conveyor 27, each loading conveyor 18 is surrounded by a directing channel which, in the exemplary embodiment shown, is designed as a U-shaped trough 35 which is for the most part open at the top. During the further transport, opposite side and longitudinal edges of the item of laundry are pulled through the trough 35 in the feeding direction 10 between the belt conveyors 27 and 28 and are thereby guided to the corner finders 19 which are arranged behind the trough 35 on both sides next to the loading conveyor 18.

The end of the respective side edge region of the item of laundry in the region of the relevant corner finder 19 is detected by detection means by in each case at least one such detection means being provided on the outside next to each corner finder 19 on both sides of the belt conveyor 28. As a result of the independent detection means of each corner finder 19, a possibly successive running past of the end of the left and right side edge of the item of laundry is detected independently of each other by, for example, sensor lines. As soon as the running of a rear end of a side edge region of the item of laundry past the one or other corner finder 19 is detected by the corresponding sensor line, the drive of the driven roller 31 of the respective corner finder 19 is stopped. A corner of an originally rear transverse edge is then fixed by each corner finder 19 in the manner of a clip, specifically in such a manner that the outermost point of the relevant corner of the item of laundry is still just located in the roller nip 33, but at least shortly in front of the latter.

As soon as the two independently operating corner finders 19 on opposite sides of the belt conveyor 28 have detected and fixed a respective corner of the item of laundry tightly at the outermost corner point, the two corners of the originally lower transverse edge and now front transverse edge of the item of laundry are grasped and clamped by the two transfer clips 20 of the pair of transfer clips 21 which have been moved up close to the corner finders 19.

The item of laundry which is held on the pair of transfer clips 21 by opposite corner regions of a transverse edge which is now located at the front is transferred by said pair of transfer clips to two free adjacent spreading clips 14 of the spreading device 12 that form a pair of spreading clips.

From the central loading station 11, the pair of transfer clips 21 together with the item of laundry loaded at the central loading station 11 is moved along the rail 22, which runs rectilinearly in the feeding direction 10, to the upper end 25 of said rail, in particular is moved obliquely upwards. Said end 25 is located in the vertical longitudinal center plane of the apparatus or insertion machine. At the end 25 of the rail 22, the item of laundry is transferred from the two transfer clips 20 of the pair of transfer clips 21 to two spreading clips 14 of a pair of spreading clips that have moved to the center of the insertion machine and have open sides of the clip mouths directed towards each other. Said two spreading clips 14 are subsequently moved uniformly apart in opposite directions in order to spread the now upper transverse edge of the item of laundry.

As a result of the transfer of the item of laundry to the centrally positioned spreading clips 14 of the pair of spreading clips, the item of laundry is already centered centrally in front of the feed conveyor 17 after the spreading of the front or upper transverse edge. The item of laundry can then be transferred by the spreading clips 14 directly to the front end of the feed conveyor 17 by depositing of a transversely directed front edge region, which adjoins the front transverse edge of the item of laundry, onto the front region of the feed conveyor 17 or onto a depositing strip assigned to the feed conveyor 17.

In a special manner according to the invention, items of laundry are transferred from each of the two outer loading stations 11 to two closest free spreading clips 14 of a pair of spreading clips. This transfer operation is clarified by FIGS. 8 to 12 in conjunction with the right loading station 11 shown in the figures mentioned.

Figure 9:
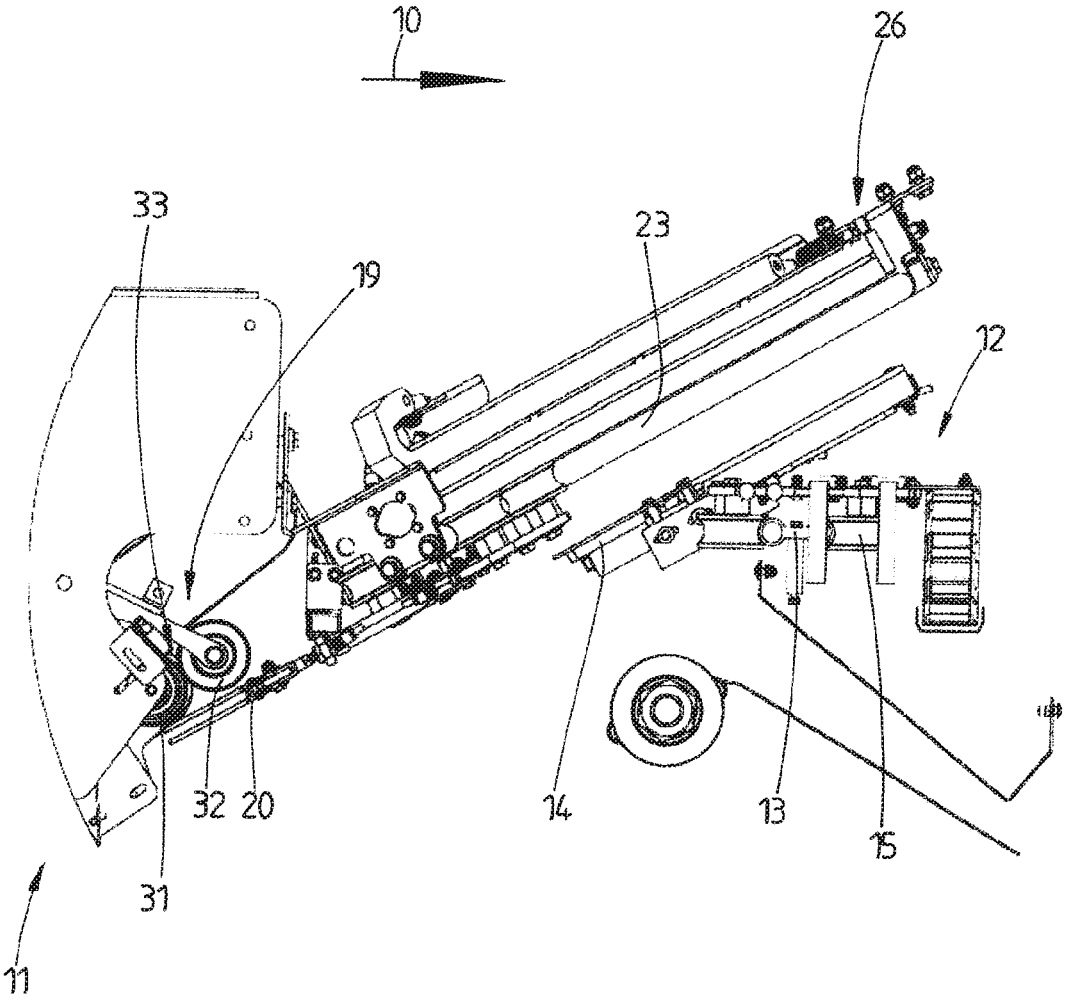
FIG. 9 shows the insertion machine of FIG. 8 in a partially illustrated side view.

In the starting position (FIGS. 8 and 9), the pair of transfer clips 21 is located at the outer lower end of the rail 23 behind the two corner finders 19 (FIG. 9). In this position, the pair of transfer clips 21 takes over an item of laundry from the corner finders 19, and therefore each transfer clip 20 holds one corner of the front transverse edge of the item of laundry.

The transfer clips 20 of the pair of transfer clips 21 are moved together from the starting position into the vicinity of the center of the feed conveyor 17. As a result, the item of laundry is transferred close to the center by the pair of transfer clips 21 to a pair of spreading clips 14. In the process, the relevant pair of transfer clips 21 also passes on the oblique rail 23 to the rear end 26 of same. Said end 26 of the rail 23 is located above and offset in the feeding direction 10 towards the spreading device 12 with respect to the lower end of same. The rail 23 is thereby directed obliquely in three-dimensional space, specifically in the same manner as the rail 24 of the left loading station 11, which rail, however, is oriented in a mirror-inverted manner with respect to the rail 23.

Figure 10:
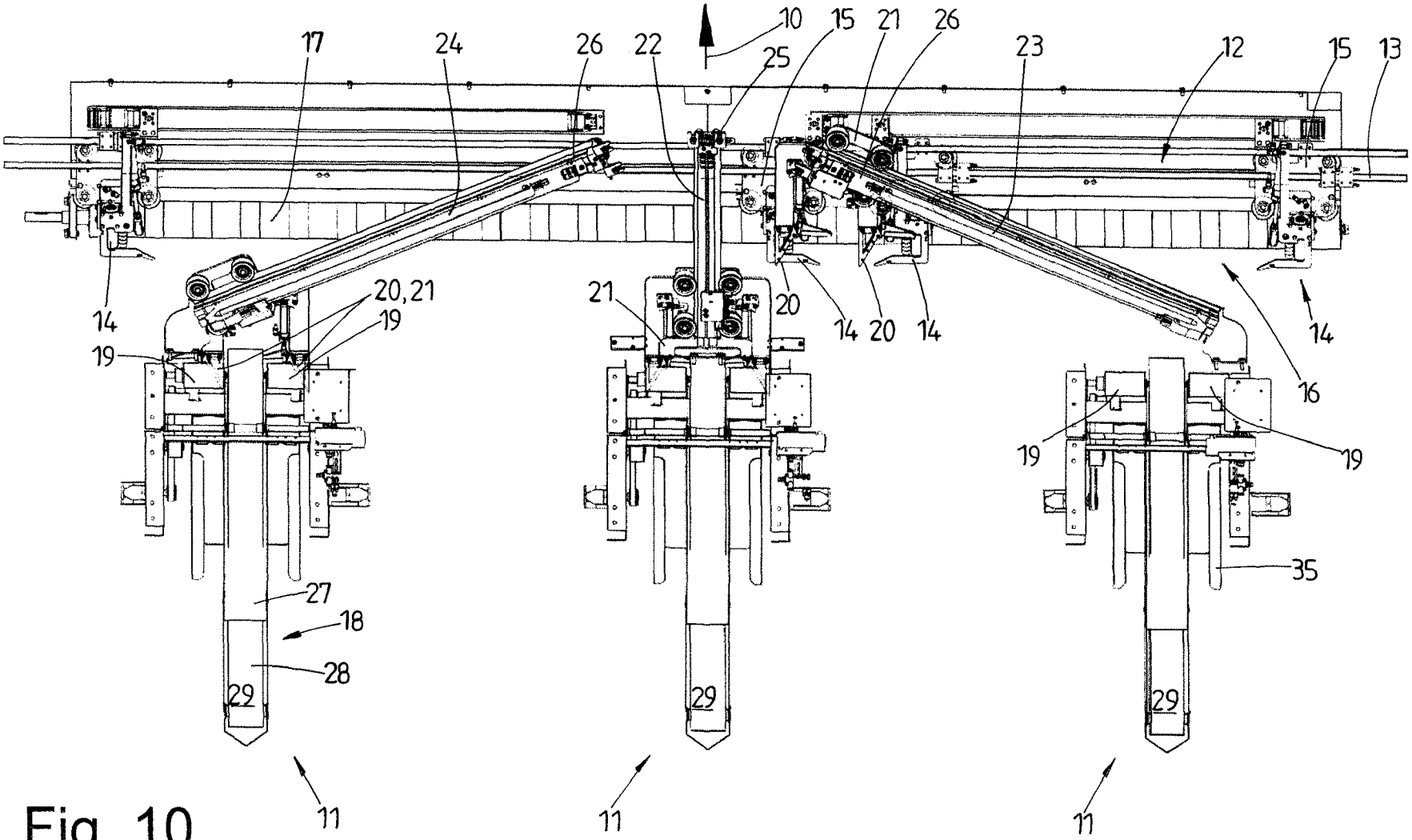
FIG. 10 shows a top view of a partially illustrated insertion machine in a transfer position.

The upper rear end 26 of the rail ends at a distance in front of the end 25 of the central rail 22. The pair of transfer clips 21 which is moved to the end 26 of the rail 23 is therefore located at a distance next to the vertical longitudinal center plane of the insertion machine. At this eccentric location, the item of laundry is transferred from the transfer clips 20 of the pair of transfer clips 21 to the spreading clips 14, which have already moved therebehind, are waiting or are moved behind the pair of transfer clips 21 later on, of a free pair of spreading clips located closest at the transfer point (FIGS. 10 and 11).

After the spreading clips 14 of the pair of spreading clips have taken over the item of laundry from the pair of transfer clips 21 and have firmly clamped said item of laundry at opposite corner regions of a front transverse edge, the spreading clips 14 are moved apart in order to stretch out the front transverse edge of the item of laundry. In the process, the (left) spreading clip 14 located at a distance next to the vertical longitudinal center plane of the apparatus covers a greater distance than the other (right) spreading clip 14, which is spaced further from the longitudinal center plane, of the pair of spreading clips holding the item of laundry. In particular, the spreading clip 14 located closer to the vertical longitudinal center plane has to pass through the longitudinal center plane in order to stretch out the front transverse edge of the item of laundry and to spread out the item of laundry. The differently long travel distances of the spreading clips 14 of the pair of spreading clips are selected in such a manner that, when the transverse edge is stretched out, the item of laundry held by said spreading clips is also centered centrally in front of the feed conveyor 17. The item of laundry is subsequently transferred from the spreading clips 14 in precisely the same manner as has been described previously in conjunction with the transfer of the item of laundry to the spreading clips 14 from the rail 22 of the central loading station 11.

As a result of the central movement of the pair of transfer clips 21 of the outer loading station 11 before a respective item of laundry is transferred to a pair of spreading clips of the spreading device 12, the travel distance of that spreading clip 14 which has to move out beyond the center of the apparatus or insertion machine in order to stretch and spread out the respective item of laundry is shorter. As a result, the difference in the travel distances of the spreading clips 14 of the pair of spreading clips holding a respective item of laundry is smaller, when the item of laundry is transferred close to the center from the pair of transfer clips 21 to the pair of spreading clips, in comparison to the transfer of the respective item of laundry to the pair of spreading clips directly behind the respective eccentric loading station 11. As a result, the cycle time for spreading out and centrally centering the respective item of laundry is reduced.

Figure 12:
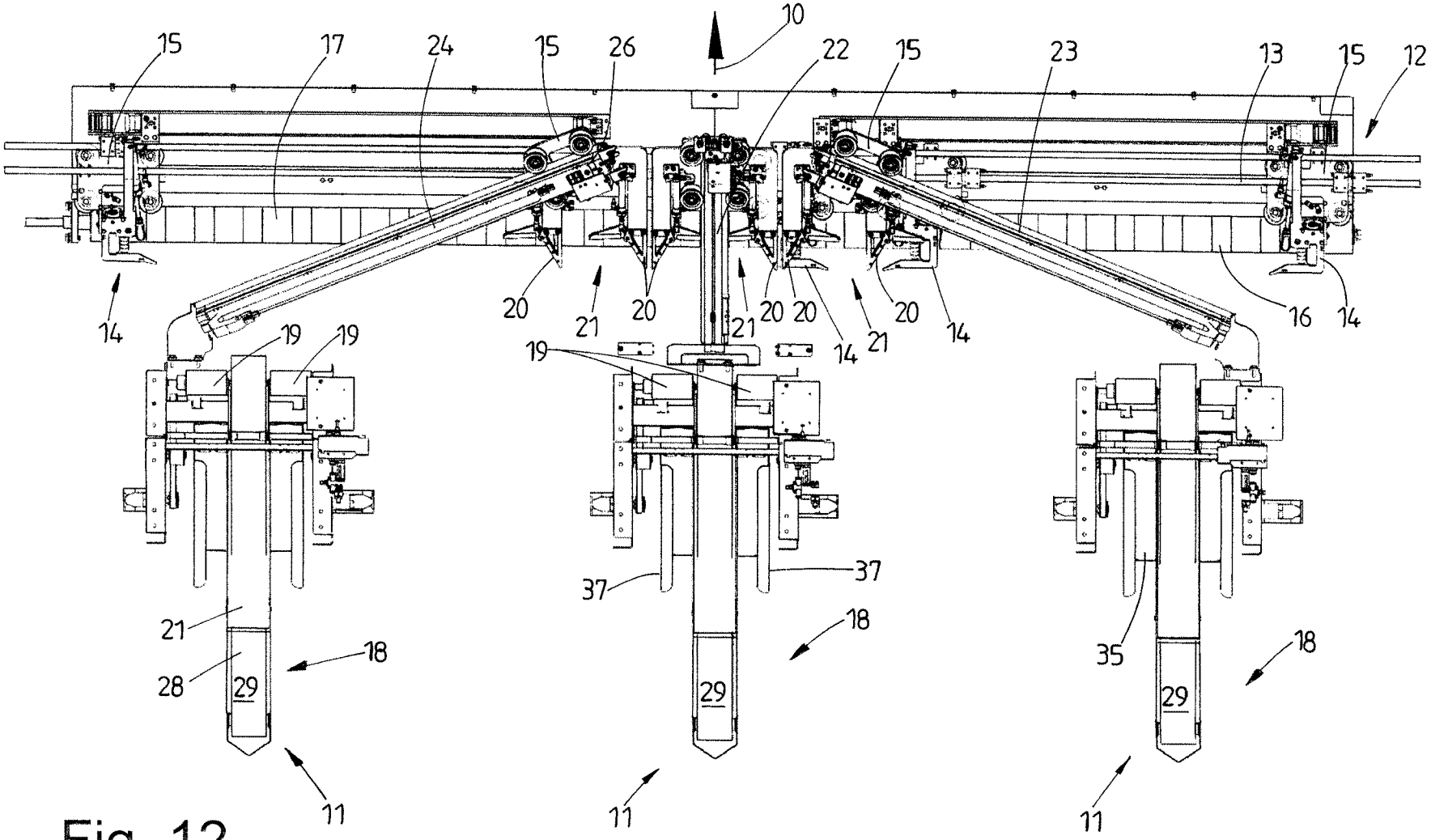
FIG. 12 shows a top view of a partially illustrated insertion machine in a different operating position.

The pairs of transfer clips 21 on each of the rails 22, 23 and 24 and the spreading clips 14 of the spreading device 12 are located in two different parallel planes (FIG. 11). However, said planes lie as tightly together as possible so that the spreading clips 14 can move past the transfer clips 20 and the slides thereof, but the transfer of the corners of the respective item of laundry from the pair of transfer clips 21 to the spreading clips 14 is reliably possible. Owing to the fact that the transfer clips 20 can run along the spreading clips 14, it is possible for a plurality of, or else all of the pairs of transfer clips 21 to be located at the upper end 25, 26 of the respective rail 22, 23 and 24 without them colliding as a result (FIG. 12). The spreading clips 14, specifically both empty spreading clips 14 and spreading clips 14 carrying items of laundry can also pass through unobstructed behind the pairs of transfer clips 21 on the transversely directed rail of the spreading device 12. By means of said independent movability of the pairs of transfer clips 21, which constitutes a further independent invention, and the overtaking possibility between the transfer clips 20 and the spreading clips 14, the cycle time of the insertion machine is also reduced because, for example, while a spreading operation of one item of laundry is in progress, the next item of laundry can already be moved in the direction of the center of the feed conveyor 17 by a pair of transfer clips 21 in a position for transfer to the next and/or other pair of spreading clips. The spreading operation of a transverse edge of a next item of laundry can also already begin when the pair of transfer clips 21 transferring said item of laundry to the spreading clips 14 is still in the transfer position.

According to the invention, the loading stations 11, the spreading device 12 and the pairs of transfer clips 21 are mounted pivotably on a frame of the insertion machine.

From an operating position shown in FIG. 1, the loading stations 11 together with the spreading device 12 and the pairs of transfer clips 21 are pivotable upwards into a release position (shown in FIG. 2) of the front end 16 of the feed conveyor 17. For this purpose, the loading station 11, the spreading device 12 and the pairs of transfer clips 21 together with the rails 13, 22, 23, 24 assigned thereto are mounted on a pivoting device 59.

Figure 2:
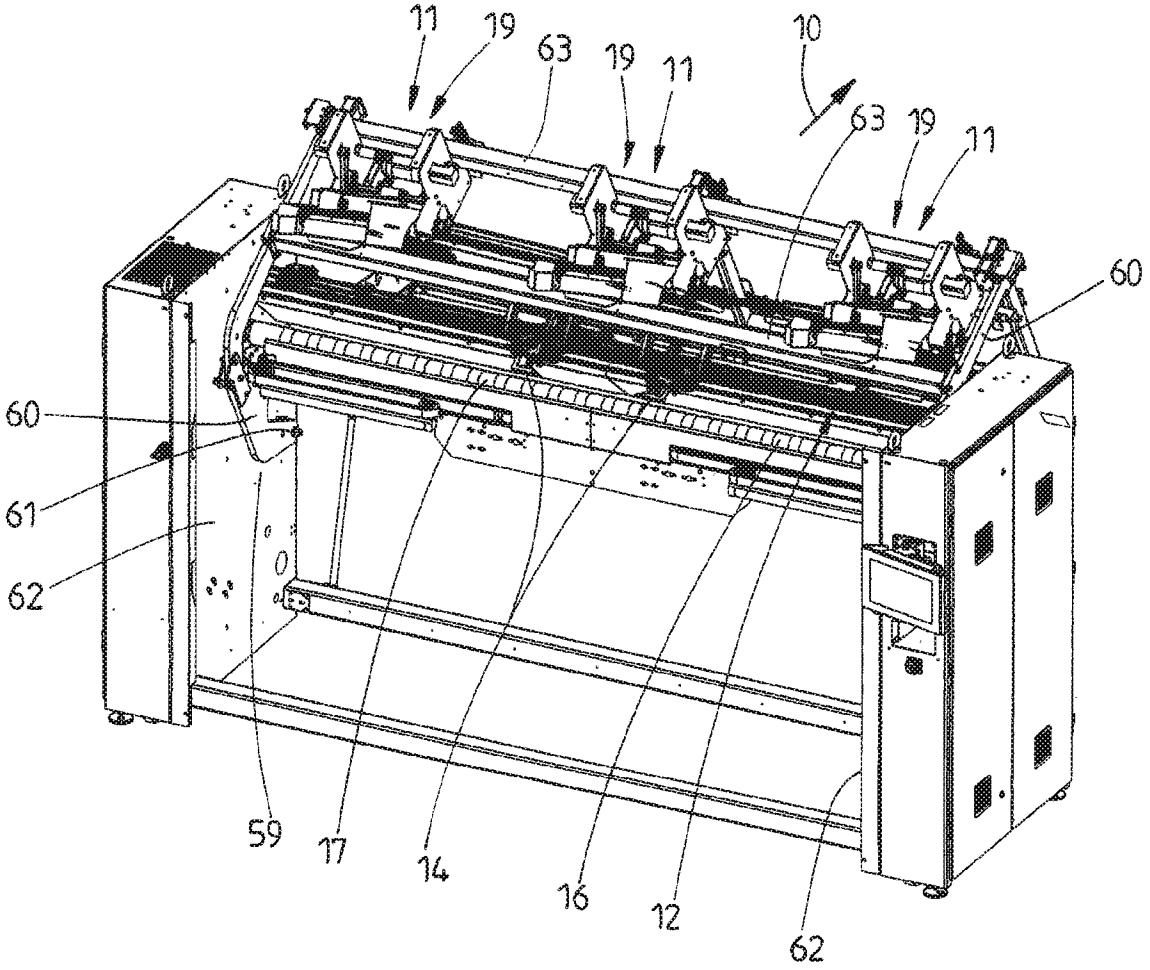
FIG. 2 shows the insertion machine of FIG. 1 with loading stations, spreading clips and transfer clips pivoted away.
Figure 3:
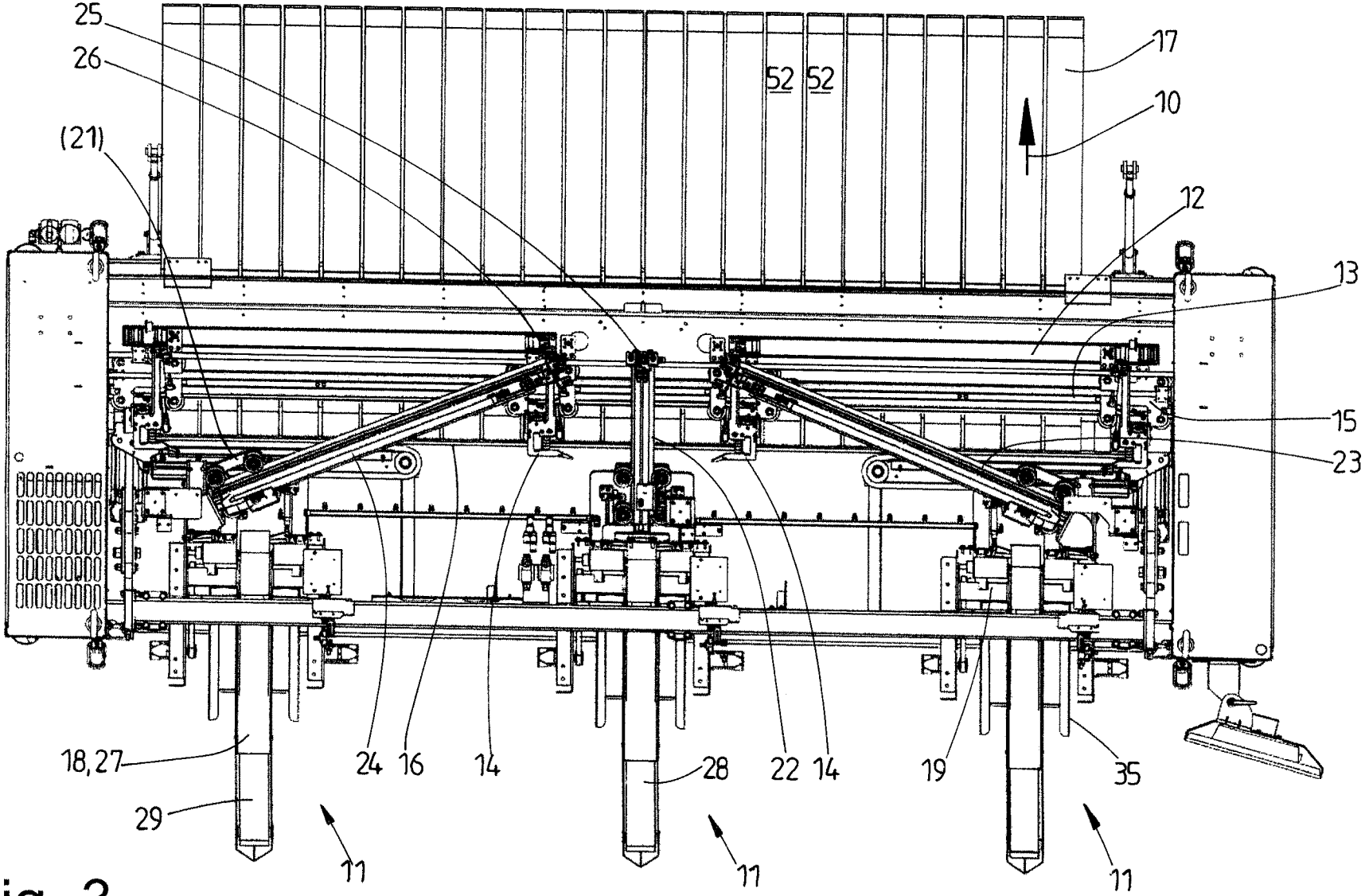
FIG. 3 shows a top view of the insertion machine of FIG. 1.
Figure 4:
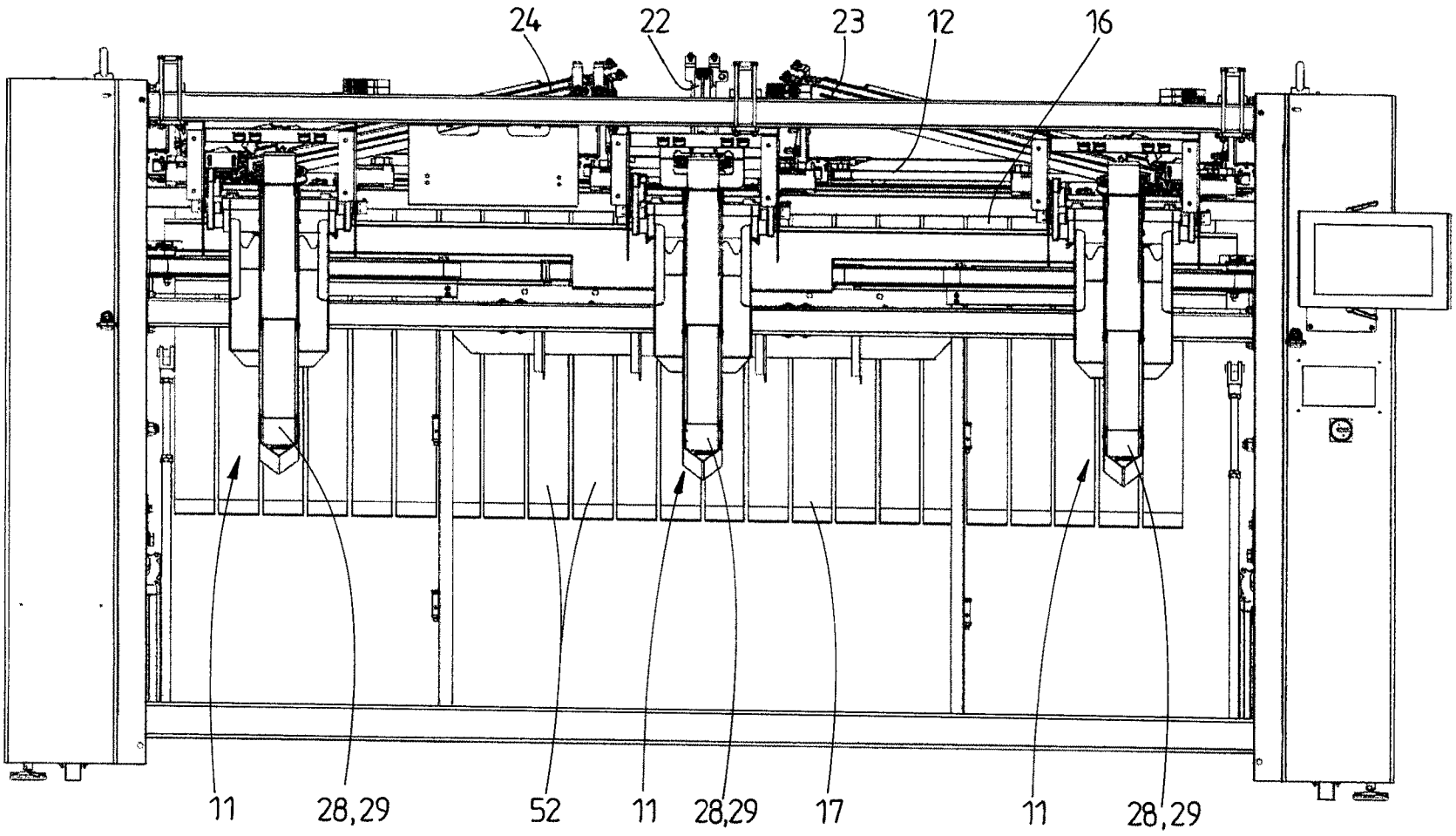
FIG. 4 shows a front view of the insertion machine of FIGS. 1 and 3.

In the region of opposite longitudinal edges or sides of the feed conveyor 17, the pivoting device 59 shown in FIGS. 1 and 2 has a respective rocker 60 which is of L-shaped design in the present case. The two opposite rockers 60 are mounted at a free end so as to be pivotable about an axis of rotation 61 on opposite sidewalls 62 of the frame of the insertion machine. The rockers 60, which are assigned to the two opposite longitudinal edges of the feed conveyor 17, of the pivoting device 59 are connected to each other by cross members 63, which run transversely with respect to the feeding direction 10, to form a three-dimensional frame supporting mechanism. Said frame supporting mechanism also serves for fixing the rails 13 of the spreading device 12, the rails 22, 23, 24 of the pairs of transfer clips 21 and optionally also the loading station 11 on the pivoting device 59.

The loading station 11, the spreading device 12 and the pairs of transfer clips 21 can be pivoted upwards by the pivoting device 59 into an out-of-operation position in such a manner that the front end 16 of the feed conveyor 17 is then freely accessible by means of at least one operator without obstruction, for example in order to place oil cloths manually at the front onto the feed conveyor 17, the oil cloth serving for waxing a mangle arranged downstream of the insertion machine. After the waxing of the mangle has been finished, the loading station 11, the spreading device 12 and the pairs of transfer clips 21 are pivoted back again into their operating position shown in FIG. 1 by the pivoting device 59 being pivoted back.

The above-described inventions are suitable for all types of insertion machines, i.e. are not limited to the apparatus or insertion machine previously described and shown in the figures. The inventions are also suitable for apparatuses or insertion machines having only one, two or else more than three loading stations.

LIST OF REFERENCE SIGNS

10 Feeding direction
11 Loading station
12 Spreading device
13 Rail
14 Spreading clip
15 Moving carriage
16 Front end
17 Feed conveyor
18 Loading conveyor
19 Corner finder

20 Transfer clip
21 Pair of transfer clips
22 Rail
23 Rail
24 Rail
25 End
26 End
27 Belt conveyor
28 Belt conveyor
29 Placing-on region
30 End
31 Roller
32 Roller
33 Roller nip
34 Circumferential surface
35 Trough
36 End side
37 Sidewall
38 Supporting means
39 Carrying run
40 Item of laundry
41 Deflecting drum
42 Transverse edge region
43 Angle
44 Return run
45 Deflecting pulley
46 Deflecting drum
47 Deflecting drum
48 Return run
49 Upper edge strip
50 Lower edge strip
51 Carrying run
52 Conveyor belt
53 Deflecting drum
54 Deflecting drum
55 Suction box
56 Top wall
57 Perforation
58 Axis of rotation
59 Pivoting device
60 Rocker
61 Axis of rotation
62 Sidewall
63 Cross member

What is claimed is:

1. A method for feeding items of laundry to a laundry treatment device, preferably a mangle, comprising:

supplying the items of laundry at a plurality of loading stations (11) arranged next to one another;

transferring one item of laundry in each case by adjacent corner regions of a front edge to spreading clips (14) of a spreading device (12), the spreading clips being moveable transversely with respect to the feeding direction (10) of the item of laundry; and stretching and centering the front edge of the item of laundry by the spreading clips (14) with respect to the center of a feed conveyor (17), wherein the outer loading stations (11) are spaced at a distance from the center of the feed conveyor (17), wherein the specific item of laundry is transferred to the spreading clips (14) at a lesser distance from the center of the feed conveyor (17) compared to the distance of the outer loading stations (11) from the center of the feed conveyor (17), and wherein the items of laundry at the outer loading stations (11) are taken over by transfer clips that transfer the items of laundry to the spreading clips (14) adjacent to the center of the feed conveyor (17).

2. The method according to claim 1, wherein the item of laundry is transferred when spreading clips (14) of a pair of spreading clips are brought together.

3. The method according to claim 1, wherein the spreading clips (14) for receiving the item of laundry are at such a reduced distance from the center of the feed conveyor (17) compared to outer loading stations (11) that the spreading clip (14) of the respective pair of spreading clips which is adjacent to the center of the feed conveyor (17) is spaced from the center of the feed conveyor (17) by half to the entire distance between the spreading clips (14) of the pair of spreading clips.

4. The method according to claim 1, wherein the respective item of laundry is transferred from a central loading station (11), which is arranged between outer loading stations (11), to a central pair of spreading clips, which is moved to the center of the feed conveyor (17).

5. The method according to claim 1, wherein the items of laundry are transferred at the loading stations (11) to a respective moveable pair of transfer clips (21), and the item of laundry which is held by the pair of transfer clips (21) is moved by the latter to the next pair of spreading clips and, in an end position of the pair of transfer clips (21), is transferred by the latter to the pair of spreading clips.

6. The method according to claim 5, wherein transfer clips (20) of outer loading stations (11) are moved into end positions which are spaced less far away from the center of the feed conveyor (17) than relevant outer loading stations (11), preferably by 1 to 1½ times the distance of the transfer clips (20) of the respective pair of transfer clips (21).

7. The method according to claim 6, wherein the transfer clips (20) of outer loading stations (11) are moved into end positions which are spaced less far away from the center of the feed conveyor (17) than relevant outer loading stations (11), namely by 1 to 1½ times the distance of the transfer clips (20) of the respective pair of transfer clips (21).

8. An apparatus for feeding items of laundry to a laundry treatment device, in particular a mangle, comprising:

a feed conveyor (17) for transporting the items of laundry in the feeding direction (10) to the laundry treatment device;

a plurality of loading stations (11) lying next to one another in a row running transversely with respect to the feeding direction (10);

a pair of transfer clips (21), which is assigned to each loading station (11), with two transfer clips (20) for taking over a respective item of laundry from the loading station (1) assigned to them; and a spreading device (12) having spreading clips (14) to which a transfer can be made from the transfer clips (20) of adjacent corners of a front edge of the respective item of laundry, wherein the transfer clips (20) of outer loading stations (11) are moveable on obliquely directed rails (23, 24) in the direction of a center of the feed conveyor (17), and the rails (23, 24) of the outer loading station (11) end at a distance next to the center of the feed conveyor (17) such that, for the transfer of laundry items to the spreading clips (14), the pairs of transfer clips (21) of the rails (23, 24) are moveable to the center of the feed conveyor (17) only to the extent that, for transferring the item of laundry to the spreading clips (14), the center of the respective pair of transfer clips (21) is spaced by 1 to 1½ times the distance of the two transfer clips (20) of the respective pair of transfer clips (21) from the center of the feed conveyor (17).

9. The apparatus according to claim 8, wherein the rails (23, 24) which are arranged downstream of loading stations (11) lying on the outside next to the center of the feed conveyor (17) run obliquely in the direction of the feed conveyor (17), as seen in the movement direction of the pairs of transfer clips (21).

10. The apparatus according to claim 8, wherein the pairs of transfer clips (21) are moveable, as seen in the feeding direction (10), into end positions upstream of a respective pair of spreading clips.

11. The apparatus according to claim 10, wherein, when at least one pair of transfer clips (21) is moved into the end position, the spreading clips (14) are moveable along behind same.

12. An apparatus for feeding items of laundry to a laundry treatment device, in particular a mangle, comprising:

at least one loading station (11);

a feed conveyor (17) transporting the items of laundry in the feeding direction (10) to the laundry treatment device;

a spreading device (12), which is arranged upstream of said feed conveyor, for spreading out the respective item of laundry upstream of the feed conveyor (17); and at least one loading station (11) upstream of the spreading device (12), wherein each loading station (11) has a loading conveyor (18) with two belt conveyors (27, 28) arranged one above the other, an upper belt conveyor (27) leaves free a front part of a lower belt conveyor (28) in order to form an placing-on region (29), and the front part of the lower belt conveyor (28) forming the exposed placing-on region (29) is adjustable, and wherein the inclination of the placing-on region (29) is adjustable by pivoting a front deflecting drum (47) of the lower belt conveyor (28) about an imaginary pivot axis in the region of the rearmost point of the placing-on region (29), as seen in the feeding direction (10).

13. An apparatus for feeding items of laundry to a laundry treatment device, in particular a mangle, comprising:

at least one loading station (11);

a feed conveyor (17) transporting the items of laundry in the feeding direction (10) to the laundry treatment device;

a spreading device (12), which is arranged upstream of said feed conveyor, for spreading out the respective item of laundry upstream of the feed conveyor (17); and at least one loading station (11) upstream of the spreading device (12), wherein each loading station (11) has a loading conveyor (18) with two belt conveyors (27, 28) arranged one above the other, an upper belt conveyor (27) leaves free a front part of a lower belt conveyor (28) in order to form an placing-on region (29), and the front part of the lower belt conveyor (28) forming the exposed placing-on region (29) is adjustable, and wherein the height of the start of the placing-on region (29) is adjustable by a change in height of a front deflecting drum (47) of the lower belt conveyor (28) about an imaginary pivot axis in the region of the rearmost point of the placing-on region (29), as seen in the feeding direction (10).

14. A method for feeding items of laundry to a laundry treatment device, preferably a mangle, comprising:

supplying the items of laundry at at least one loading station (11);

transferring one item of laundry in each case by adjacent corner regions of a front edge to spreading clips (14) of a spreading device (12), the spreading clips being moveable transversely with respect to the feeding direction (10) of the item of laundry; and stretching and centering the front edge of the item of laundry by the spreading clips (14) with respect to the center of the feed conveyor (17), wherein the at least one loading station (11) can be shifted as required in order to provide operators with access to a front depositing region of the feed conveyor (17), and wherein the at least one loading station (11) additionally together with the spreading device (12) and transfer clips (20) with associated rails (13; 22, 23, 24) can be shifted when required.

15. A method for feeding items of laundry to a laundry treatment device, preferably a mangle, comprising:

supplying the items of laundry at at least one loading station (11);

transferring one item of laundry in each case by adjacent corner regions of a front edge to spreading clips (14) of a spreading device (12), the spreading clips being moveable transversely with respect to the feeding direction (10) of the item of laundry; and stretching and centering the front edge of the item of laundry by the spreading clips (14) with respect to the center of the feed conveyor (17), wherein the at least one loading station (11) can be shifted as required in order to provide operators with access to a front depositing region of the feed conveyor (17), and wherein the at least one loading station (11) additionally together with the spreading device (12) and transfer clips (20) with associated rails (13; 22, 23, 24) can be pivoted upwards when required by a common pivoting device (59) in order to release a depositing region at the front end (16) of the feed conveyor (17).

* * * * *